US006357849B2

(12) United States Patent
Takizawa et al.

(10) Patent No.: US 6,357,849 B2
(45) Date of Patent: Mar. 19, 2002

(54) INKJET RECORDING APPARATUS

(75) Inventors: Jinichi Takizawa; Toshihisa Saruta; Hiroaki Tojo; Hironori Endo, all of Nagano-ken (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/433,119

(22) Filed: Nov. 3, 1999

(30) Foreign Application Priority Data

Nov. 12, 1998 (JP) ..... 10-322013

(51) Int. Cl.[7] ..... B41J 28/393; B41J 29/38
(52) U.S. Cl. ..... 347/19; 347/14
(58) Field of Search ..... 347/7, 19; 250/341.1

(56) References Cited

U.S. PATENT DOCUMENTS 6,012,794 A * 1/2000 Nakano et al. ..... 347/7
6,048,045 A * 4/2000 Nohata et al. ..... 347/7

FOREIGN PATENT DOCUMENTS

EP 0925929 A2 6/1999 ..... B41J/29/393
EP 0925951 A2 6/1999 ..... B41J/2/05
EP 1059172 A2 12/2000 ..... B41J/29/393
JP 10119307 A 5/1998 ..... B41J/2/175
JP 10-193643 7/1998 ..... B41J/2/175
JP 10-226089 8/1998 ..... B41J/3/04
JP 11-170556 6/1999 ..... B41J/2/175
JP 11179884 A 7/1999 ..... B41J/2/01
JP 11-179934 7/1999 ..... B41J/2/175
JP 11188853 A 7/1999 ..... B41J/2/01
JP 2001-54954 2/2001 ..... B41J/2/175

* cited by examiner

*Primary Examiner*—John Barlow
*Assistant Examiner*—A. Dudding
(74) *Attorney, Agent, or Firm*—Beyer Weaver & Thomas, LLP

(57) ABSTRACT

A printing apparatus of the present invention includes a print head having a plurality of nozzles, from which ink droplets are ejected, a light detection unit that has a light emitting element and a light receiving element and determines the active or inactive state of the nozzles based on whether or not the light beam is intercepted by ink droplets, and a carriage that moves the print head relative to the light detection unit. The light beam emitted from the light emitting element has an optical axis that is inclined at a predetermined angle to a nozzle array. At least part of the plurality of nozzles are inspected while the print head is moving relative to the light detection unit at a fixed speed.

41 Claims, 28 Drawing Sheets

IN CASE OF BI-DIRECTIONAL PRINTING

IN CASE OF UNI-DIRECTIONAL PRINTING

INKJET RECORDING APPARATUS

BACKGROUND OF THE INVENTION

1. Field of the Invention

The present invention relates to a technique of ejecting ink droplets to implement printing.

2. Description of the Related Art

FIG. 33 shows a positional relationship between an ink ejection detector and a head in a prior art ink jet printer. In an ink jet printer with a head 801 that has a plurality of nozzle arrays 802, 808 to eject ink droplets, an ink ejection detector (a light-emitter 803 and a light-receiver 804). is generally used to detect failure of ink ejection from each nozzle, because of clogging of the nozzle or shortage of ink. In FIG. 33, 805 shows a light sensor sensitive area and the head 801 moves along an arrow 813.

The prior art ink ejection detector carries out detection of ink ejection for each nozzle. Every time failure of ink ejection is detected, because of the clogging of the nozzle, the ink jet printer requires a specific operation to prepare for resumption of ink ejection with recovery means. While in the case of shortage of ink, a new supply of ink is required for resumption of ink ejection. Accordingly a fairly long time is required to implement detection of ink ejection with regard to all the nozzles or any arbitrary nozzle array. The one-by-one nozzle detection technique takes a long time to complete detection for a large number of nozzles, and requires higher sensitivity for the ink ejection detector as nozzle density increases.

SUMMARY OF THE INVENTION

The object of the present invention is thus to provide an ink jet printer that is able to detect ink ejection from nozzles with high-accuracy.

In order to attain the above object, an ink jet printer according to the present invention comprises a carriage configured to be able to reciprocate relative to a printing medium, and a plurality of nozzle arrays mounted on the carriage to eject ink droplets, wherein the ink jet printer further comprises light detection unit scans the plurality of nozzle arrays at a predetermined angle relative to a columnar direction of the nozzle arrays, wherein the angle is attained by a clockwise or a counterclockwise rotation about a center of each nozzle array.

The light detection unit may include a light sensor that is disposed at a specific position so that light is scattered by ink droplets ejected from each nozzle array.

The light detection unit may be disposed at the predetermined angle, so that a sensitive area of the light sensor is fully utilized with regard to each nozzle array.

The light detection unit may have an optical axis arranged at a preset angle relative to a head nozzle surface.

Since the arrangement of the present invention carries out detection of ink ejection on an array-by-array basis in the ink jet printer, even if there are a plurality of nozzles that do not eject ink in one nozzle array, because of the clogging, the present invention use recovery means once for each array but not once for each nozzle, thereby shortening a time period from detection of ink ejection failure to its recovery with the recovery means.

Further, the inclination of the optical axis of the light detection unit (ink ejection detector) at the predetermined angle relative to the nozzle arrays, increases the light-shielding area of the sensor of the light detection unit. This improves the sensitivity of the sensor and effects high accuracy detection of ink ejection without requiring any highly sensitive ink ejection detector, even if there exist a large number of nozzles.

The present invention is also directed to an ink jet printer comprising a print head having a plurality of nozzles in arrays for ejecting ink droplets, a carriage for reciprocating the print head relative to a printing medium, and a light detection unit for detecting an ejection state of each nozzle, wherein the light detection unit includes a light-emitting element and a light-receiving element, where an optical axis connecting the light-emitting element with the light-receiving element is arranged at a predetermined angle relative to a columnar direction of the nozzles.

It is preferable that the light detection unit has a sensitive area within a predetermined distance from the optical axis, in which ink droplets are detected, and that the light detection unit is arranged at the predetermined angle relative to the columnar direction of the nozzles in order to cause nozzles on both ends of each nozzle array, among the plurality of nozzles, to be within the sensitive area.

The ink light detection unit may be arranged at a home position of the print head, or may alternatively be disposed on either one of the print head and the carriage with the print head mounted thereon. In the former case, it is preferable that the home position is also a position of blind ejection for recovery of the nozzles.

In order to attain at least part of the above objects, the present invention carries out inspection of nozzles for ejection of ink droplets with regard to an ink jet printer (printing apparatus) as discussed below. In the description hereof, the inspection for ejection of ink droplets is referred to as the 'dot dropout inspection'. The present invention is directed to an ink jet printer that ejects ink droplets and thereby implements printing. The ink jet printer includes a print head having a plurality of nozzles, from which ink droplets are ejected, a light detection unit (inspection unit) that has a light emitting element for emitting a light beam and a light receiving element for receiving the light beam emitted from the light emitting element and determines the active or inactive state of the nozzles based on whether or not the light beam is intercepted by ink droplets, and a carriage (feeding mechanism) that moves at least one of the print head and the light detection unit, so as to move the print head relative to the light detection unit. At least part of the plurality of nozzles are inspected while the print head moves relative to the light detection unit.

This arrangement ensures the higher-speed inspection of the plurality of nozzles for ejection, compared with the prior art structure that carries out the inspection for ejection while the light detection unit and the print head are at a stop. This accordingly shortens the time period required for the inspection for ejection. In the prior art structure that repeats the feed and the stop of the light detection unit or the print head for the inspection of the plurality of nozzles for ejection, the repeated feed and stop may increase the mechanical errors. The arrangement of the present invention, however, carries out the inspection of the plurality of nozzles for ejection of ink droplets while either the light detection unit or the print head is moved, thereby having no such problems.

It is preferable that the print head moves relative to the light detection unit at a fixed speed. In this arrangement, the timecan be readily estimated, when an ink droplet passes through the light beam in the process of inspection for ejection of ink droplets.

In one preferable application of the present invention, the plurality of nozzles constitute at least one nozzle array and arranged in the array at a fixed nozzle pitch in a predetermined alignment direction. In this application, the light beam is emitted in a specific direction having an angle θ relative to the predetermined alignment direction (where θ is greater than 0 and less than 180 degrees). It is further preferable that ink droplets are ejected towards the light beam while the print head is moving relative to the light detection unit at the fixed speed.

In this application, the movement of either the print head or the light detection unit causes the nozzle array to relatively pass through the light beam having the predetermined angle θ relative to the nozzle array. In the case where the alignment direction of the nozzle array is coincident with the optical axis of the light beam, all the nozzles included in the nozzle array simultaneously intersect the optical path of the light beam. The preferable application of the present invention, however, keeps the optical axis at the predetermined angle relative to the nozzle array, so that the respective nozzles included in the nozzle array sequentially intersect the optical path of the light beam. In this arrangement, the respective nozzles can be inspected sequentially for ejection.

In another preferable application of the present invention, all nozzles included in one specific nozzle array to successively eject ink droplets in the inspection from an intersection of the light beam with an ink droplet ejected from a nozzle at one end of the specific nozzle array to an intersection of the light beam with an ink droplet ejected from a nozzle at the other end of the specific nozzle array. In this application, it is preferable that the ink jet printer satisfies:

$$\sin\theta < La/D,\ CRV/F \leqq La/\cos\theta$$

where D denotes the nozzle pitch in the predetermined alignment direction, La denotes a width of the light beam emitted from the light emitting element, CRV denotes a moving speed of the print head relative to the light detection unit, and F denotes a frequency of ejection of ink droplets.

It is more preferable that the ink jet printer satisfies:

$$\sin\theta > La/D,\ CRV/F \leqq La/\cos\theta.$$

In still another preferable application of the present invention, the plurality of nozzles constitutes in a plurality of nozzle arrays. In this application, it is preferable that the ink jet printer satisfies:

$$\tan\theta > LD/(D\times(N-1))$$

where LD denotes an interval between adjoining nozzle arrays and N denotes a number of nozzles included in each nozzle array.

It is more preferable that the ink jet printer satisfies:

$$\tan\theta \leqq LD/(Dx(N-1)).$$

In accordance with one preferable embodiment of the present invention, the plurality of nozzles are classified into a plurality of inspection groups. One inspection group is selected from the plurality of inspection groups, as an object to be inspected, so that and the selected inspection group is inspected during one pass of movement of the print head relative to the light detection unit in a predetermined direction.

This arrangement enables the inspection to be carried out with high accuracy even when it is impossible to inspect all the nozzles on the print head by one pass of movement of the print head or when the accuracy of inspection is lowered in the case of inspection of all the nozzles by one pass of movement. The structure of this embodiment classifies the nozzles into the plurality of inspection groups and carries out the inspection for each inspection group. This enables the time period required for the inspection of nozzles for ejection to be divided into short time periods, and does not require any collective long time. Another required work may be interposed between the inspection of the respective inspection groups for ejection according to the requirements.

It is preferable that the plurality of nozzles are classified so that ink droplets ejected from two or more nozzles included in one identical inspection group do not simultaneously intercept the light beam emitted from said light emitting element. This arrangement enables all the nozzles included in one inspection group to be inspected for ejection of ink droplets during one pass of movement of the print head or the light detection unit.

In accordance with another preferable embodiment of the present invention, the plurality of nozzles constitutes in a plurality of nozzle arrays, and the plurality of nozzles are classified so that each of the plurality of inspection groups includes nozzles that are periodically selected at a ratio of one every n nozzles (where n is an integer of at least 2) out of at least one nozzle array among the plurality of nozzle arrays. The 'inspection group' is not required to have its constituents, that is, nozzles, in all the nozzle arrays on the print head.

In this embodiment, there is a sufficient interval between adjoining nozzles in one identical inspection group. Even when the width of the light beam emitted from the light emitting element is large relative to the nozzle pitch, this arrangement desirably reduces the possibility of confusion of ink droplets ejected from the adjoining two nozzles in the same inspection group in the process of the inspection and effectively prevents the mistakes in the inspection.

It is preferable that each of the plurality of inspection groups includes nozzles that are selected from nozzle arrays, which are periodically selected at a ratio of one every m nozzle arrays (where m is an integer of at least 2) among the plurality of nozzle arrays. The 'inspection group' is not required to have, as its constituents, all the nozzles included in the nozzle array that satisfies the above condition.

In the event that the gradient of the optical axis is large relative to the interval between adjoining nozzle arrays, the locus of an ink droplet ejected from a nozzle in one nozzle array may simultaneously pass through the light beam while the locus of an ink droplet ejected from the last nozzle in an adjoining nozzle array passes through the light beam. In the above application of the present invention, however, there is a sufficient interval between the adjoining nozzle arrays in one identical inspection group. This arrangement desirably reduces the possibility of confusion of ink droplets ejected from the nozzles in the adjoining two nozzle arrays in the same inspection group in the process of the inspection and effectively prevents the mistakes in the inspection.

In another preferable application of the present invention, different priorities corresponding to a sequence of execution of the inspection are allocated to the plurality of inspection groups. The plurality of nozzles are classified so that the inspection group having the higher priority number include a greater number of nozzles. This application may reduce the total number of inspection groups, compared with the uniform classification method that selects one nozzle out of n nozzles and accordingly classifies the nozzles into n inspection groups.

In accordance with one preferable embodiment of the present invention, the print head is driven by the carriage to move bi-directionally in a main scanning direction. A movable range of the print head in the main scanning direction includes a printing area, in which the print head causes the plurality of nozzles to eject ink droplets so as to implement printing on the printing medium, and an adjustment area, in which the inspection of the plurality of nozzles for ejection of ink droplets and a flushing operation of the plurality of nozzles are carried out. In this embodiment, it is preferable that the inspection for ejection is carried out in the adjustment area, prior to the flushing operation, at a time point when the print head reaches the adjustment area after execution of the printing in the printing area and before the print head returns from the adjustment area to the printing area.

This arrangement enables the printing to be implemented immediately after the flushing operation without the inspection for ejection. This desirably prevents the non-smooth ejection of ink and the curved flight of ink droplets, which are due to the increased viscosity of ink by the elapse of time used for the inspection.

It is alternatively preferable that the inspection of one of the inspection groups for ejection is carried out in the adjustment area respectively in a forward pass and a backward pass the print head, at a time point when the print head reaches the adjustment area after execution of the printing in the printing area and before the print head returns from the adjustment area to the printing area.

This arrangement enables inspection of the inspection groups to be carried out respectively in the forward pass and in the backward pass of the print head between the printing operations in the printing area. This ensures the inspection of the respective nozzles for ejection at relatively short cycles. This application accordingly prevents the possible failure of ejection of ink droplets between the inspections and ensures the high picture quality of the resulting prints.

When the printing is not carried out in the printing area in either the forward pass or the backward pass of the print head, the print head may be fed at a higher speed in the pass on which the printing is not executed, than in the other pass. The inspection for ejection is carried out in the pass, on which the print head is fed at the higher speed, it is preferable to lower the feeding speed of the print head to a specific level suitable for the inspection, prior to the inspection.

This arrangement feeds the print head at the higher speed in the pass on which the printing is not executed, thereby shortening the total time period required for printing. When the inspection for ejection is carried out, the feeding speed of the print head is lowered to ensure the required accuracy for the inspection.

The principle of the present invention may be actualized by a variety of applications given below:

(1) printing apparatus, print control apparatus;

(2) method of printing, method of control printing;

(3) computer programs to realize the above apparatuses and the methods;

(4) recording media, on which computer programs realizing the above apparatuses and the methods are recorded; and (5) data signals embodied in a carrier wave and including computer programs realizing the above apparatuses and the methods.

DESCRIPTION OF THE PREFERRED EMBODIMENTS

Figure 1:
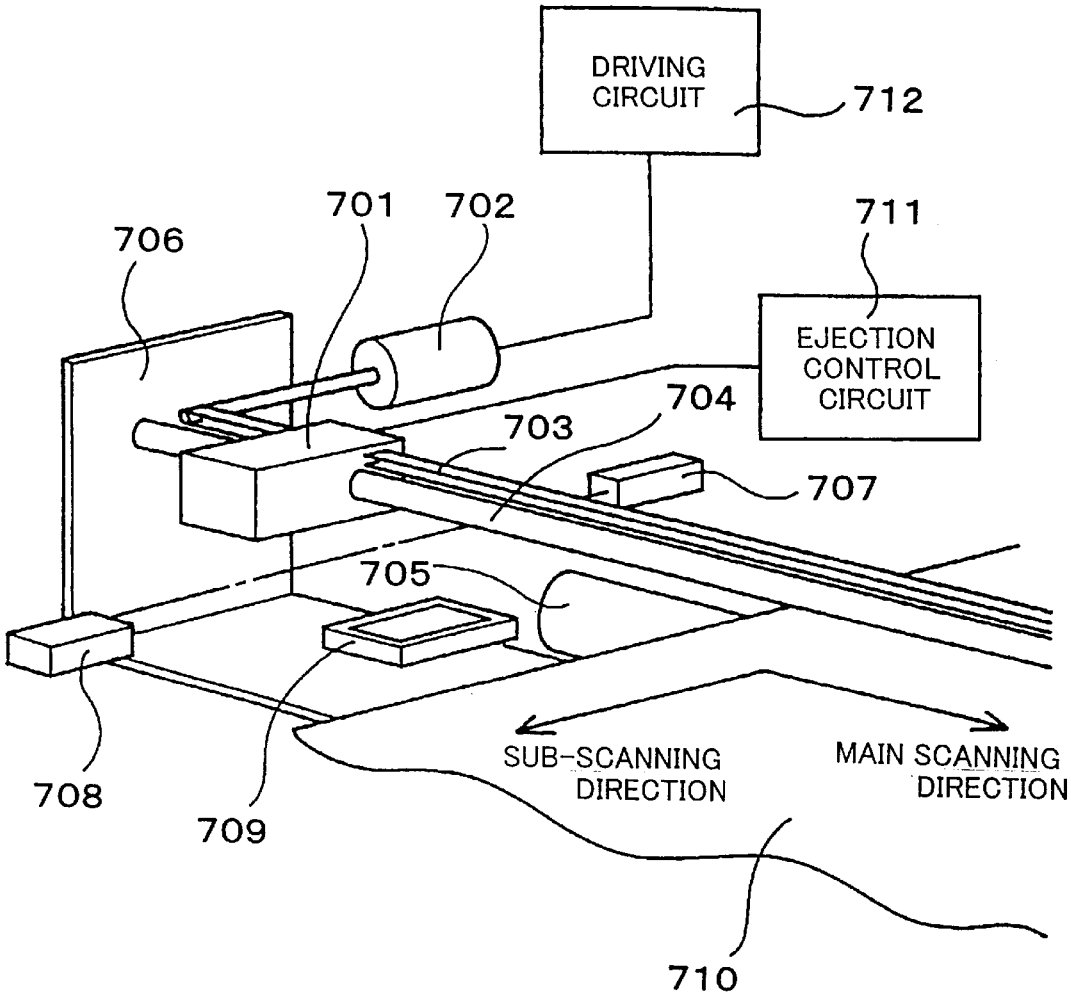
FIG. 1 illustrates an ink jet printing apparatus embodying the present invention.

Embodiments of the present invention are described in the following sequence:

A: First Embodiment
B: Second Embodiment
C: Third Embodiment
D: Fourth Embodiment
E: Fifth Embodiment A. First Embodiment FIG. 1 illustrates the structure of one embodiment of the present invention. The structure has an ink jet print head 701 and print head shifting means 702 through 704 that shifts the ink jet print head 701 in a main scanning direction. More specifically the print head shifting means includes a motor 702, a garter belt 703 that connects with the motor 702 and the ink jet print head 701, and a guide roller 704. The structure further includes a platen roller 705 that functions as sheet feeder means, a guide frame 706, a light emitter 707 that functions as light emitting means, and a light receiver 708 that is disposed at a position facing the light emitter 707 and functions as light receiving means. In all the drawings, the one-dot chain line represents the pathway of a light flux emitted from the light emitter. The structure also has an ink waste tray 709, a sheet of recording paper 710, an ejection control circuit 711 that functions as ink droplet ejection control means, and a driving circuit 712 of the motor 702.

In the procedure of recording characters and figures on the sheet of printing paper 710, the motor 702 is first driven to shift the ink jet print head 701 to a preset position in the main scanning direction. The ejection control circuit 711 then transmits print data to the ink jet print head 701. The ink jet print head 701 successively ejects ink droplets against the recording paper 710 to create dots and thereby implement recording, while shifting in the main scanning direction. On completion of the printing in the main scanning direction, the platen roller 705 is rotated by a preset amount by means of a non-illustrated motor and a non-illustrated control circuit so as to feed the recording paper 710 in a sub-scanning direction. The series of these processes is repeatedly carried out, so that the characters and figures are recorded on the recording paper 710.

Figure 2:
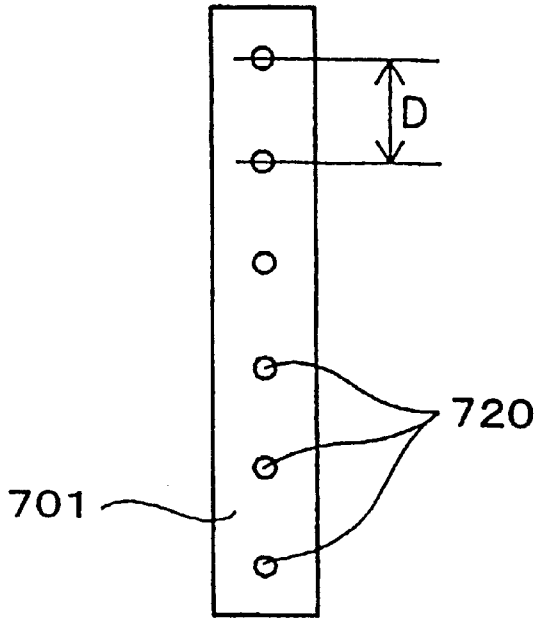
FIG. 2 shows an arrangement of nozzles on an ink jet print head in the first embodiment of the present invention.

FIG. 2 shows an array of nozzles formed in the ink jet print head 701. In this embodiment, there are six nozzles 720 arranged at intervals of D [$\mu$m].

Figure 3:
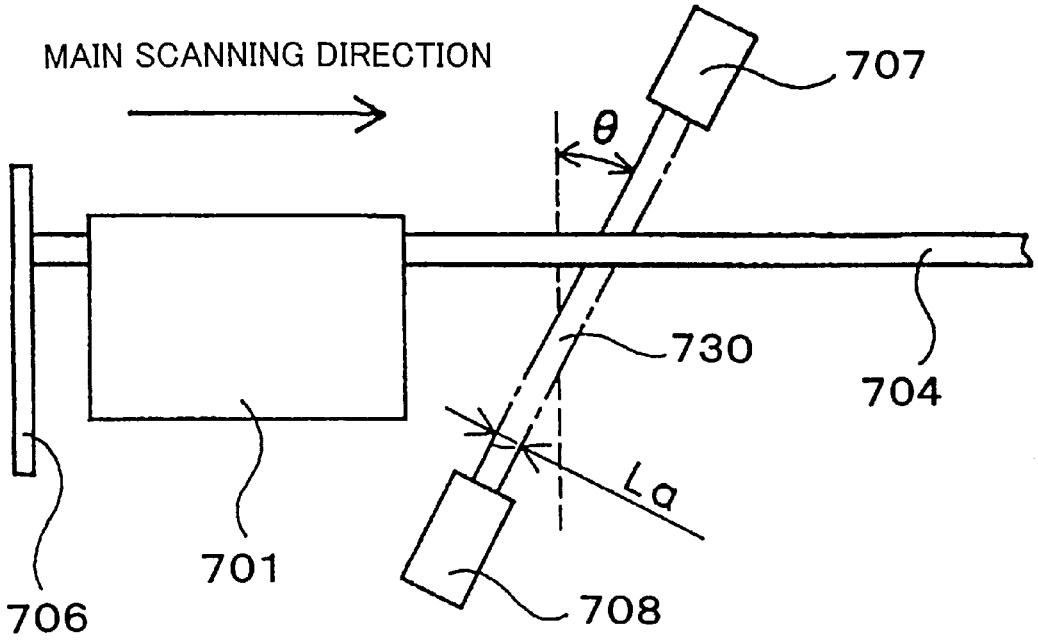
FIG. 3 shows the positional relationship between the ink jet print head and a light flux.

FIG. 3 is a top view of the structure shown in FIG. 1. A light flux 730 emitted from the light emitter 707 has a width of La [$\mu$m] as illustrated. In this drawing, the broken line represents the direction of the nozzle array formed in the ink jet print head 701 shown in FIG. 2. The light flux 730 is located at an angle θ relative to the direction of the nozzle array represented by this broken line.

Figure 4:
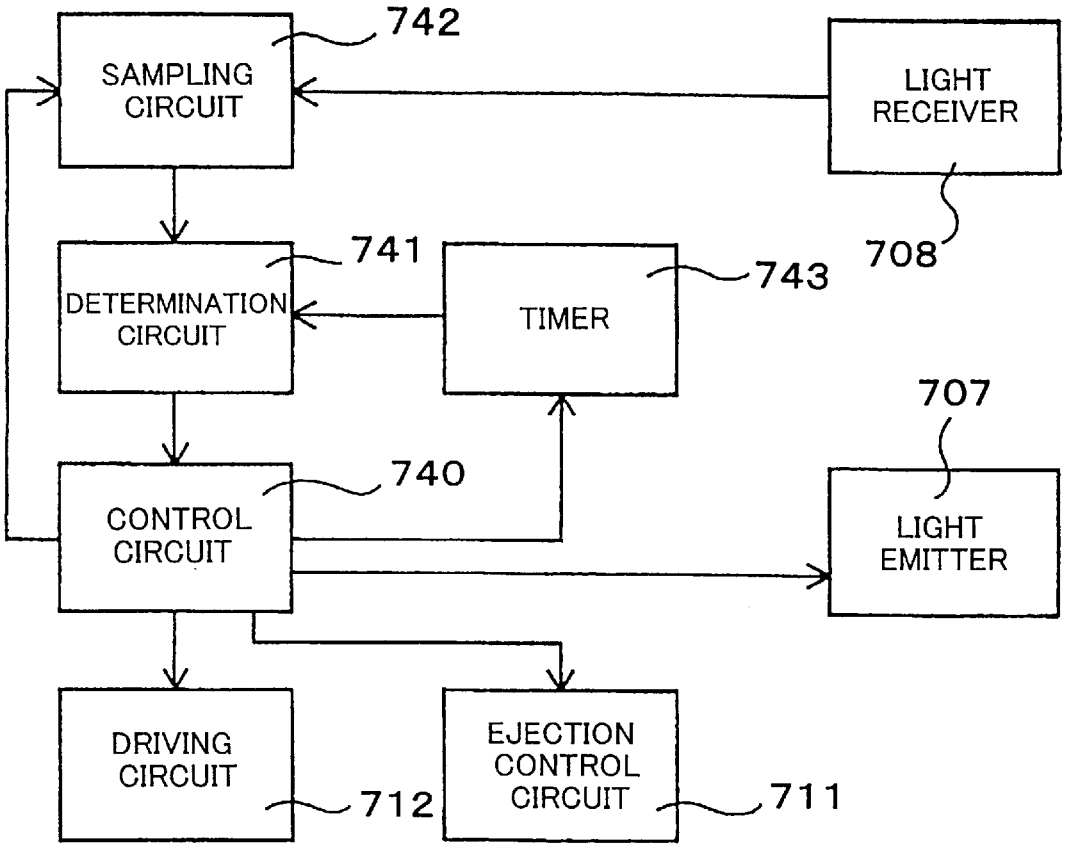
FIG. 4 is a block diagram showing a circuit for carrying out detection.
Figure 5:
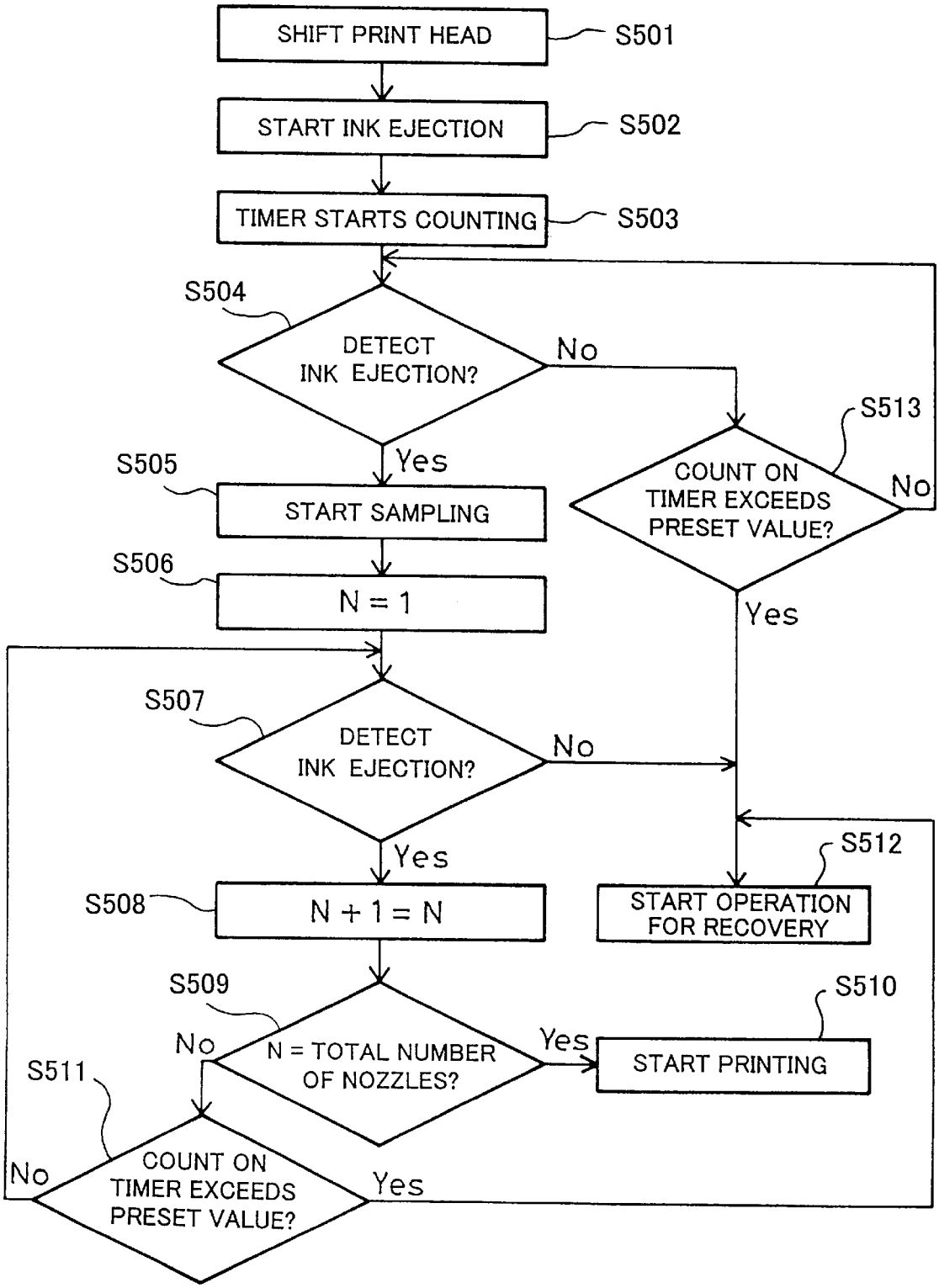
FIG. 5 is a flowchart showing a detection routine.
Figure 6:
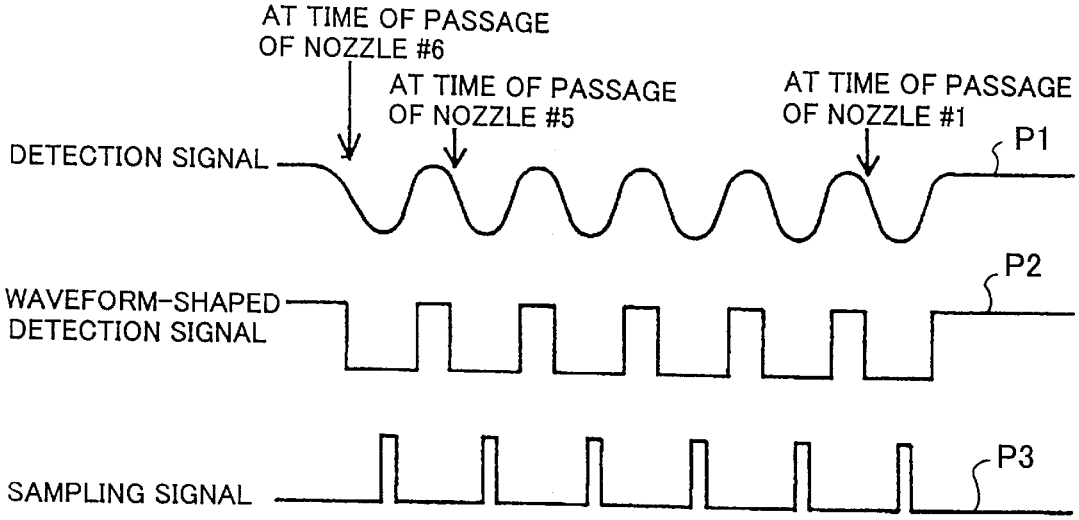
FIG. 6 is a time chart showing signals transmitted between the blocks in the circuit of FIG. 4.

A detection procedure of the present invention is described with FIGS. 4, 5, and 6. FIG. 4 is a block diagram illustrating a circuit structure that detects ink droplets in this embodiment. FIG. 5 is a flowchart showing a detection routine. FIG. 6 is a time chart. The circuit structure shown in FIG. 4 includes a control circuit 740, a determination circuit 741 that determines abnormality of ejection, a sampling circuit 742 that samples a detection signal output from the light receiver 708 at fixed cycles, and a timer 743 that counts the time. The detection procedure is described with the flowchart of FIG. 5. At step S501, the control circuit 740 first drives the driving circuit 712 to shift the ink jet print head 701 staying between the guide frame 706 and the light flux 730 in the main scanning direction as shown in FIG. 3.

Figure 7:
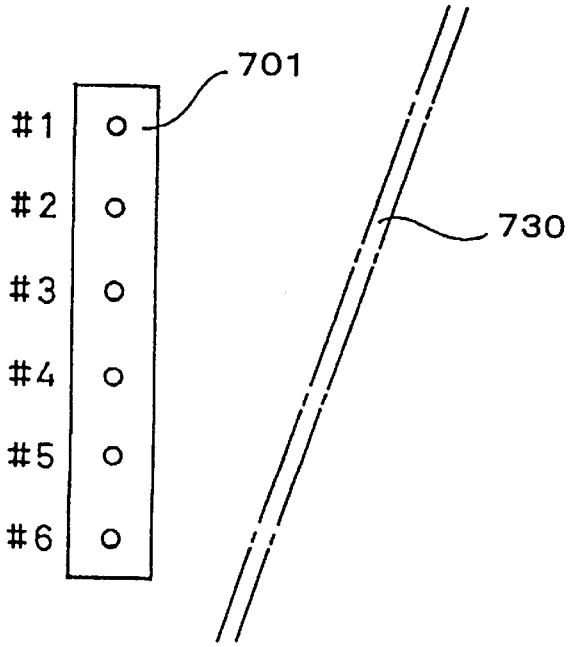
FIG. 7 shows the positional relationship between the ink jet print head and the light flux at the time of starting ejection.

FIGS. 7 through 10 illustrate the position of the ink jet print head 701 relative to the light flux 730. When the ink jet print head 701 has the positional relation shown in FIG. 7, at step S502 the control circuit 740 drives the ejection control circuit 711, which then causes all the nozzles formed in the ink jet print head 701 to eject ink droplets. The positional relationship of FIG. 7 is decided so that even a specific nozzle that passes through the light flux 730 first among all the nozzles required for recording, that is, a nozzle #6 in the example of FIG. 7, is sufficiently apart from the light flux 730. At step S503, the control circuit 740 simultaneously drives the timer 743, which then starts counting the time.

Figure 8:
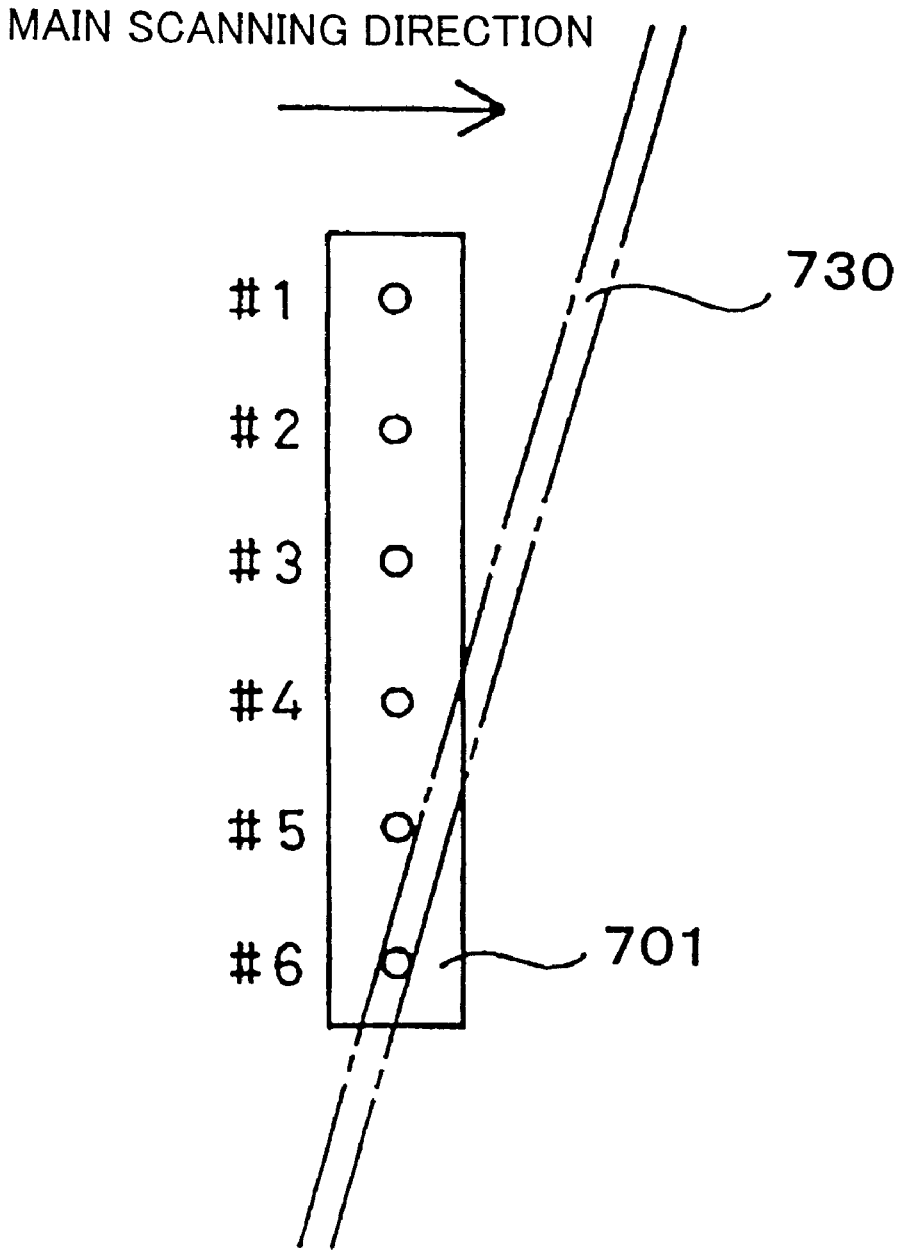
FIG. 8 shows the positional relationship between the ink jet print head and the light flux at the time of detecting the nozzle #6.

When the ink jet print head 701 shifts in the main scanning direction to the position shown in FIG. 8, an ink droplet ejected from the nozzle #6 passes through the light flux 730. At this moment the quantity of light detected by the light receiver 708 decreases from the level of the observed quantity of light under the condition that no ink droplet passes through the light flux 730. The detection signal output P1 from the light receiver 708 accordingly changes at the time when the nozzle #6 passes through the light flux 730 (see FIG. 6). If the ink ejection is detected and the detection signal output P1 changes (at step S504), the sampling circuit 742 shapes the waveform of the detection signal to give a waveform-shaped detection signal P2 shown in FIG. 6. With the output variation of the detection signal P3 causes, the sampling circuit 742 carries out sampling at the timing of a sampling signal shown in FIG. 6.

Simultaneously with the start of operation of the sampling circuit 742, at step S506, the determination circuit 741 registers a value '1' into an ejecting nozzle count register N that is incorporated in the determination circuit 741.

Figure 9:
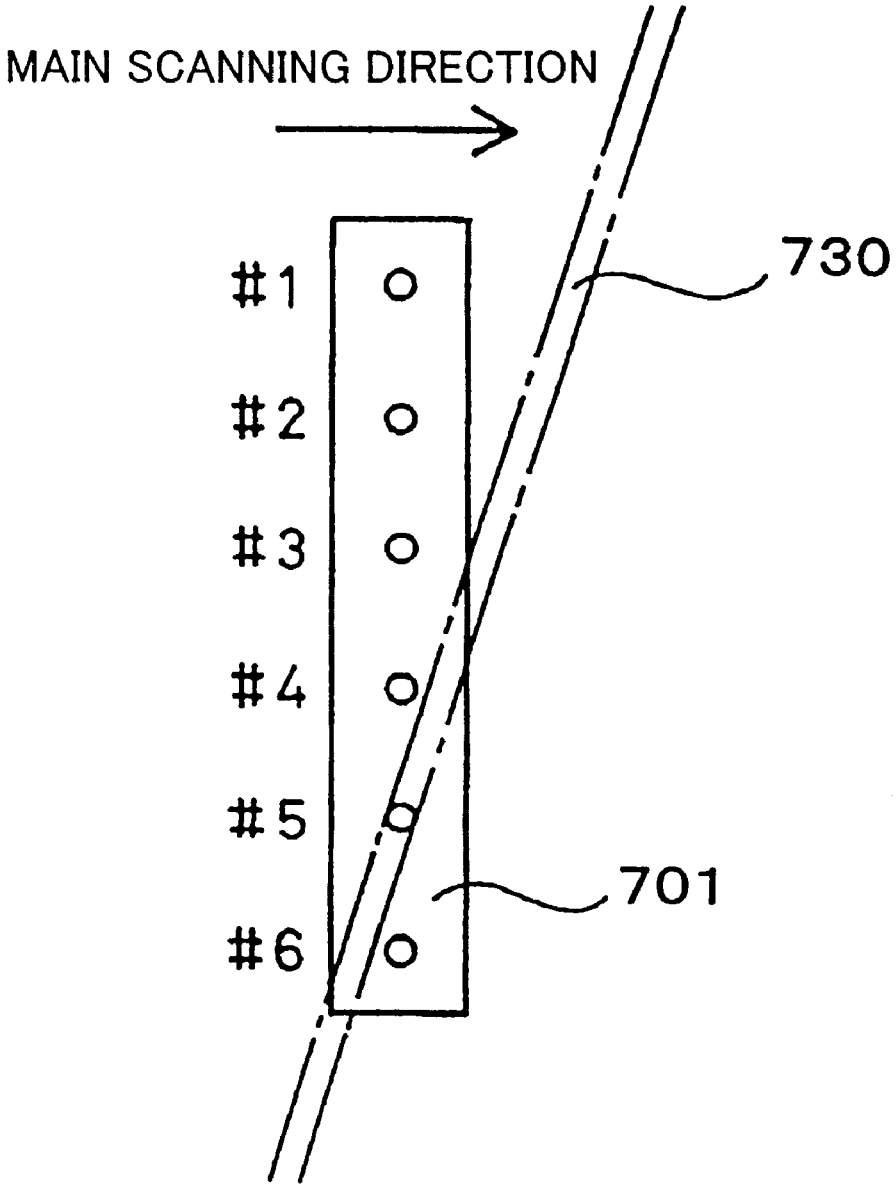
FIG. 9 shows the positional relationship between the ink jet print head and the light flux at the time of detecting the nozzle #5.

When the ink jet print head 701 further shifts in the main scanning direction to the position shown in FIG. 9, an ink droplet ejected from a nozzle #5 passes through the light flux 730. At this moment the quantity of light detected by the light receiver 708 decreases from the level of the observed quantity of light under the condition that no ink droplet passes through the light flux 730, in the same way when the nozzle #6 passes through the light flux 730. The detection signal output from the light receiver 708 accordingly has an output variation at the time when the nozzle #5 passes through the light flux 730 (see FIG. 6). If the ink ejection is detected and the detection signal output P1 changes (at step S507), the sampling circuit 742 then carries out sampling at the timing of the sampling signal shown in FIG. 6. At step S508, the determination circuit 741 adds the value '1' to the ejecting nozzle count register N, that is, registers a value '2' into the ejecting nozzle count register N.

Figure 10:
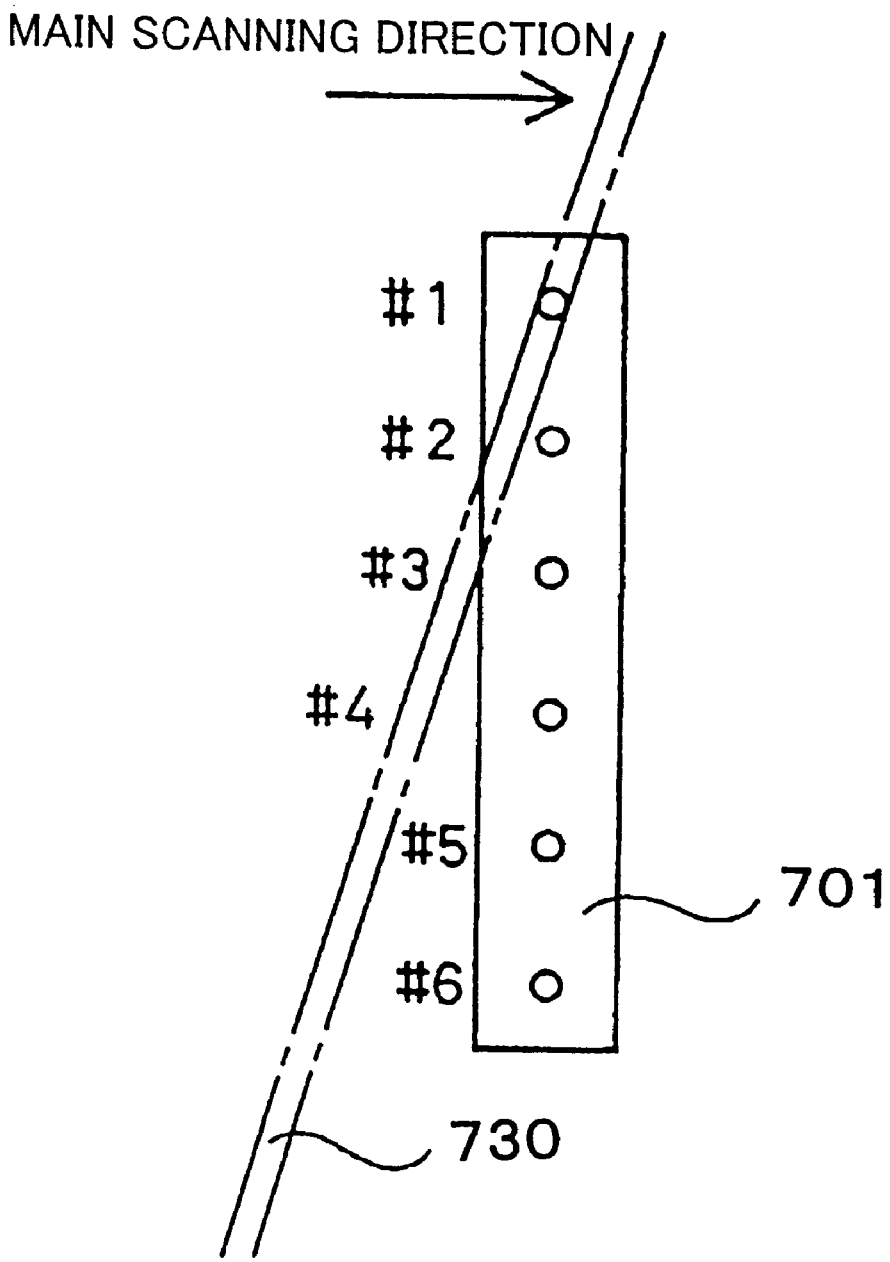
FIG. 10 shows the positional relationship between the ink jet print head and the light flux at the time of detecting the nozzle #1.

With a further shift of the ink jet print head 701 in the main scanning direction, the detection is successively carried out in the sequence of a nozzle #4, a nozzle #3, a nozzle #2, and a nozzle #1 shown in FIG. 10.

When detection of the nozzle #1 is completed and the value registered in the ejecting nozzle count register N is equal to 6, which is identical with the total number of nozzles, the printing operation starts immediately at step S510. If the nozzle #3, for example, fails ink ejection, however, the value registered in the ejecting nozzle count register N is equal to 5. In the case where the value of the ejecting nozzle count register N is not equal to the total number of nozzles at step S509 and the count of the timer 743 exceeds a preset time period at step S511, which is sufficient to allow all the nozzles to pass through the light flux 730 after the detection of the nozzle #1, the determination circuit 741 determines that there is a nozzle that fails ink ejection. Based on the result of the determination, the control circuit 740 stops the shift of the ink jet print head 701 in the main scanning direction and starts an operation required for recovery of the nozzle at step S512. In the case where all the nozzles fail ink ejection at step S504, the determination circuit 741 also determines the failure of ink ejection at step S513, based on the count of the timer 743. The control circuit 740 also stops the shift of the ink jet print head 701 and starts an operation for the recovery at step S512.

In this embodiment, the light flux 730 is inclined to the nozzle array at the angle of θ so that the detection can be carried out in the course of the shift of the ink jet print head 701. When the angle 0 is set to allow a pair of ink droplets ejected from adjoining nozzles to pass through the light flux 730 simultaneously, ink ejection of either one nozzle or zero nozzle is detected in the case of abnormality. This makes the determination rather difficult. As in the example of FIGS. 7 through 10, it is accordingly required to set the angle θ equal to a specific value that does not allow any pair of ink droplets ejected from adjoining nozzles to pass through the light flux 730 simultaneously. The required condition is given by first expression below;

$$\sin\theta \geqq La/D$$

where D denotes a nozzle interval in the sub-scanning direction, and La denotes the width of the light flux 730 in the main scanning direction.

Concrete values in this embodiment are D=140 [μm] and La=100 [μm]. Substitution of these values into the above first expression gives θ≧45 degrees. When the first expression is modified as:

$$\sin\theta > La/D,$$

the given condition is θ>45 degrees. The condition that causes at least one ink droplet to pass through the light flux is given by second expression below:

$$CRV/F \leqq La/\cos\theta$$

where CRV denotes a travel speed of the ink jet print head 701 passing through the light flux 730, and F denotes a driving frequency of ejection of ink droplets. Setting the angle θ determines the ratio of CRV to F. Concrete values in this embodiment are CRV=750 [mm/s] and F=10800 [Hz], which satisfy the second expression.

A light emitting element applied for the light emitter of the embodiment may be a semiconductor laser or an LED. Both of them make the embodiment to exert the effects of the present invention. It is desirable to make the light flux 730 closer to parallel rays with an increase in number of nozzles. Combination of the light flux 730 with a condenser lens enables the detection with higher accuracy.

A light receiving element applied for the light receiver of the embodiment may be a photodiode, a phototransistor, or a CCD. All of them make the embodiment to exert the effects of the present invention.

B. Second Embodiment

Figure 11:
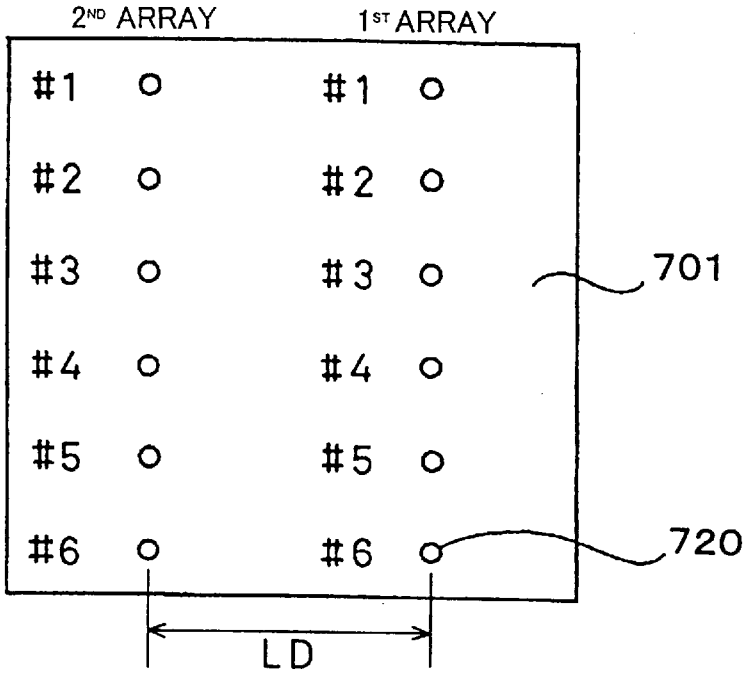
FIG. 11 shows an arrangement of nozzles on an ink jet print head in a second embodiment according to the present invention.
Figure 12:
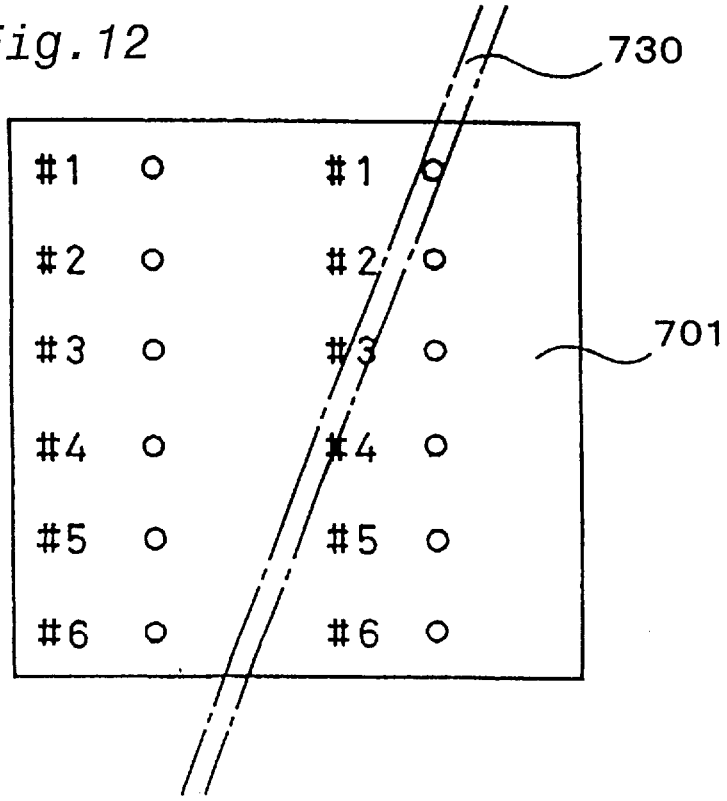
FIG. 12 shows the positional relationship between the ink jet print head and a light flux at the time of detecting the nozzle #1 in the first nozzle array.
Figure 13:
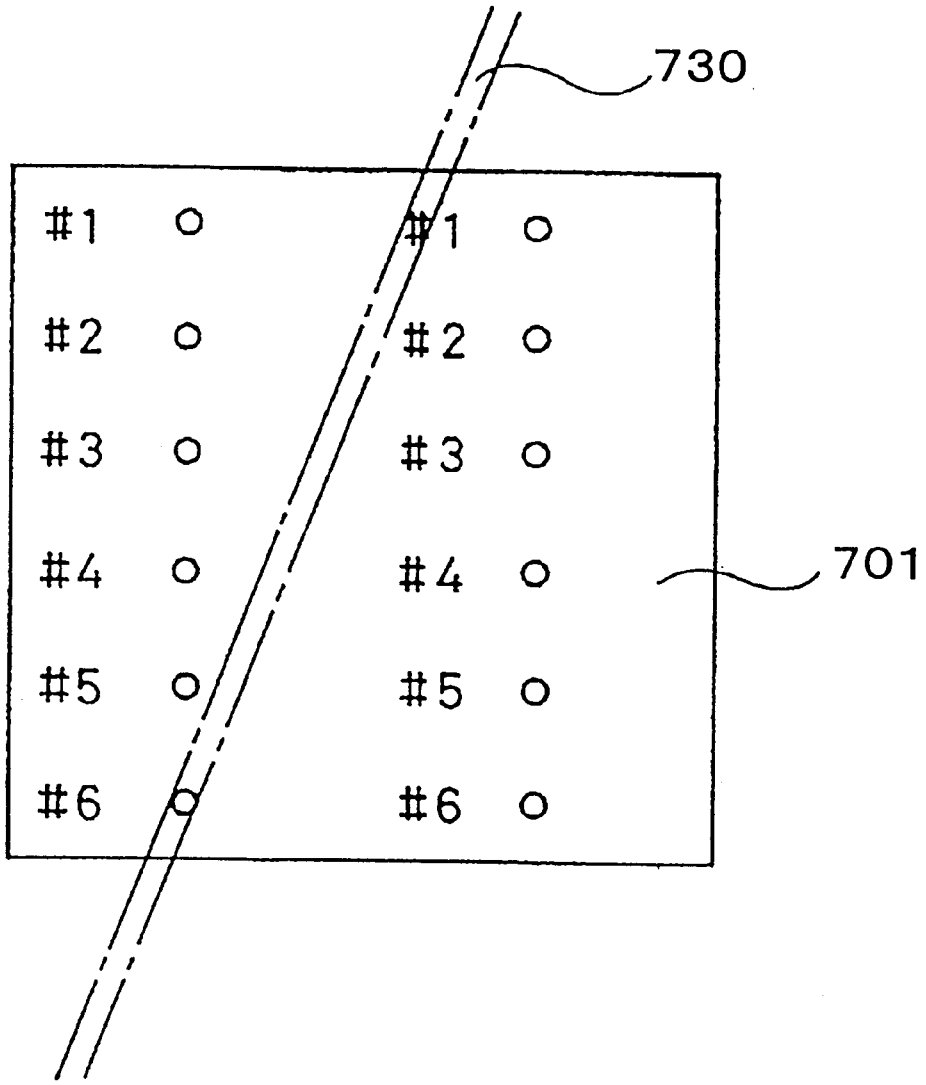
FIG. 13 shows the positional relationship between the ink jet print head and the light flux at the time of detecting the nozzle #6 in the second nozzle array.

A second embodiment of the present invention is shown in FIG. 11. FIG. 11 illustrates the ink jet print head 701 having a plurality of nozzle arrays that are arranged at an interval LD. FIGS. 12 and 13 show the states in which the ink jet print head 701 passes through the light flux 730.

At the position of FIG. 12, a nozzle #1 in a first array is detected. With a further shift of the ink jet print head 701 in the main scanning direction, a nozzle #6 in a second array is detected at the position of FIG. 13. The procedure of detecting the nozzles #6 through #1 in the first array is identical with the procedure discussed in the first embodiment. The procedure of detecting the nozzles #6 through #1 in the second array is also identical with the procedure discussed in the first embodiment and is carried out immediately after the detection in the first array.

When the ink jet print head 701 has the plurality of nozzle arrays, it is required to set a condition in addition to the conditions of the first expression and the second expression given above. The condition is that prevents any pair of nozzles included in adjoining nozzle arrays from passing through the light flux simultaneously.

This condition is given as third expression below:

$$\tan\theta \leqq LD/(D\times(N-1))$$

where LD denotes the interval between the adjoining nozzle arrays, and N denotes the number of nozzles. In this embodiment, the required interval LD between the adjoining nozzle arrays is not less than 0.7 [mm] to fulfill the above condition. When the third expression is modified as:

$$\tan\theta < LD/(D\times(N-1)),$$

the required interval LD between the adjoining nozzle arrays is greater than 0.7 [mm] to fulfill the modified condition.

As described above, the arrangement of the first embodiment effectively detects failure of ink ejection without the process of highly accurate positioning. The arrangement of the second embodiment significantly shortens the time period required for the stop and the shift of the print head in the course of the detection with regard to the plurality of nozzle arrays, thereby enabling the high-speed detection.

C. Third Embodiment

C-1. Structure of Apparatus

Figure 14:
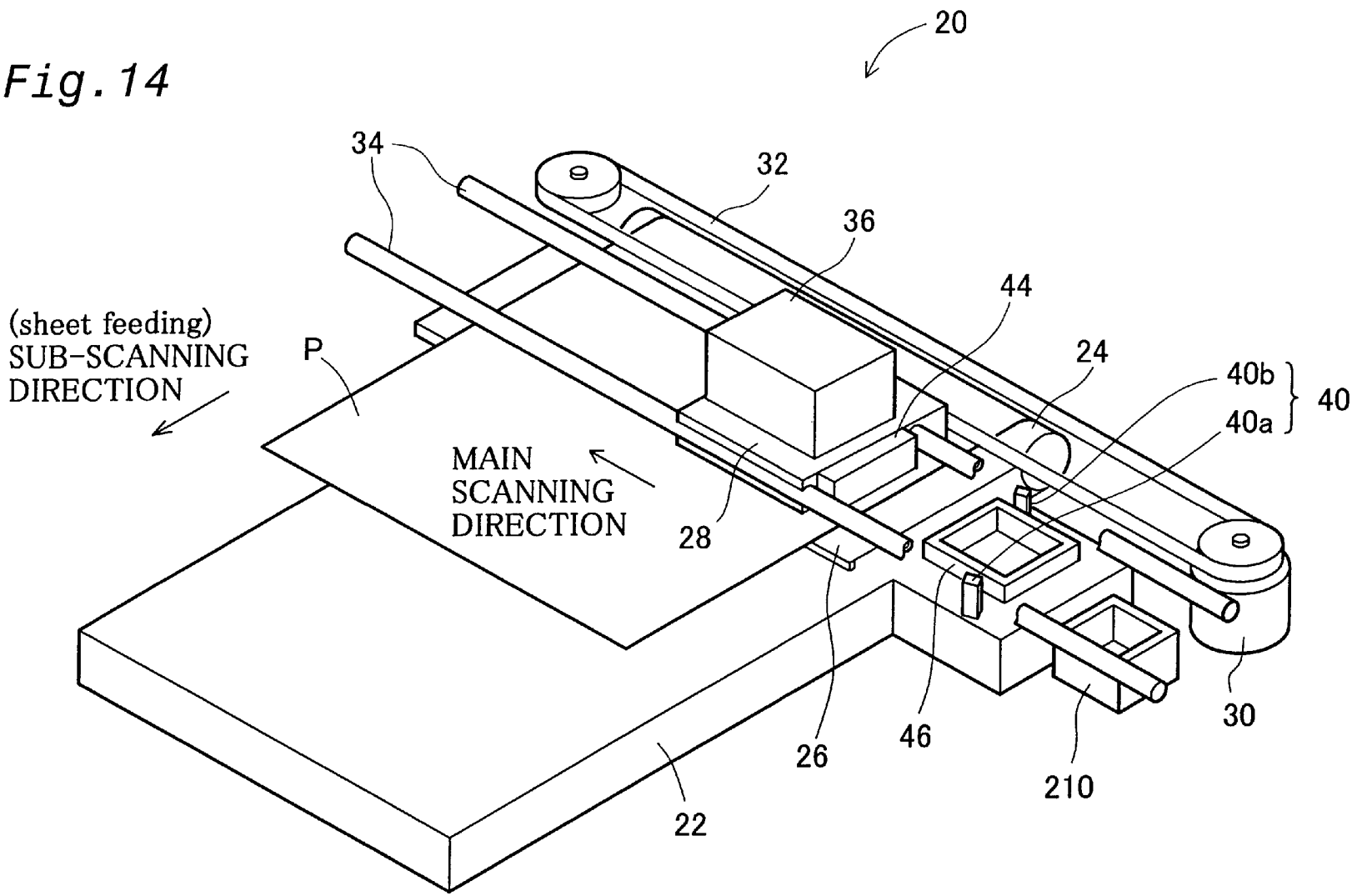
FIG. 14 is a perspective view schematically illustrating the structure of a main part of a color ink jet printer 20 in one embodiment according to the present invention.

FIG. 14 is a perspective view schematically illustrating the structure of a main part of a color ink jet printer 20 in one embodiment according to the present invention. The printer 20 includes a sheet stacker 22, a sheet feed roller 24 driven by a non-illustrated step motor, a platen plate 26, a carriage 28, a step motor 30, a traction belt 32 driven by the step motor 30, and a pair of guide rails 34 for the carriage 28. A print head 36 with a large number of nozzles formed therein is mounted on the carriage 28.

A sheet of printing paper P is wound up from the sheet stacker 22 by means of the sheet feed roller 24 and fed on the surface of the platen plate 26 in the sub-scanning direction. The carriage 28 is dragged by means of the traction belt 32 driven by the step motor 30 to move in the main scanning direction along the pair of guide rails 34. The main scanning direction is perpendicular to the sub-scanning direction. The printing operation with the print head 36 is carried out on the printing paper P set on the platen plate 26 in the course of the main scan. An area on the platen plate 26, in which the printing operation is performed, is hereinafter referred to as the 'printing area'.

Figure 15:
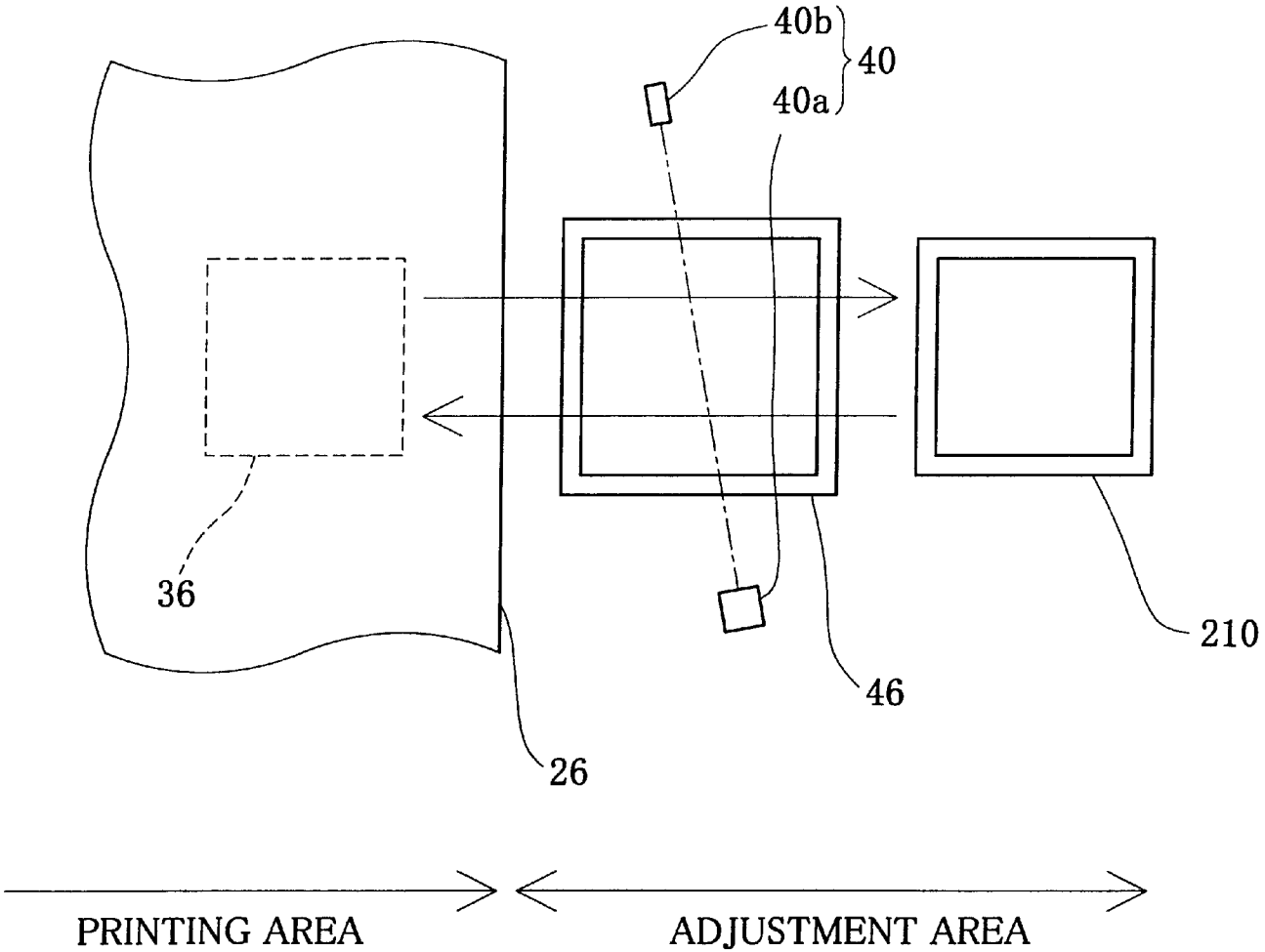
FIG. 15 shows the positional relationship among a platen plate 26, a dot dropout inspection unit 40, a waste ink tray 46, and a head cap 210.

FIG. 15 shows the position of the platen plate 26 relative to a dot dropout inspection unit 40, a waste ink tray 46, and a head cap 210. The dot dropout inspection unit 40, the waste ink tray 46, and the head cap 210 are disposed below the pair of guide rails 34 and outside the printing area (on the right side in FIG. 14). The area including the dot dropout inspection unit 40, the waste ink tray 46, and the head cap 210 is hereinafter referred to as the 'adjustment area', in contrast to the 'printing area'.

The dot dropout inspection unit 40 includes a light emitting element 40*a* and a light receiving element 40*b*, and inspects the state of flight of ink droplets by utilizing these elements 40*a* and 40*b*, so as to detect a possible dot dropout. The details of the inspection carried out by the dot dropout inspection unit 40 will be discussed later.

The waste ink tray 46 receives ink droplets ejected from the nozzles in the process of the dot dropout inspection. The bottom of the waste ink tray 46 is covered with a felt to prevent splash of ink droplets. A 'flushing' operation is carried out for the nozzles in the print head 36 at preset time intervals. In a flushing operation, these nozzles eject ink droplets , in order to prevent a possible failure of ink ejection due to the thickened ink. The flushing operation is also carried out above the waste ink tray 46, which accordingly receives ink droplets ejected in the process of the flushing operation. Namely the dot dropout inspection and the flushing operation are formed at the same position. Both the dot dropout inspection and the flushing operation can thus not be performed in the course of the shift of the print head 36 in an identical pass of the main scan, unless the print head 36 is intentionally stopped above the waste ink tray 46 for the sequential performance of the dot dropout inspection and the flushing operation.

The head cap 210 has the air tightness and covers the print head 36 during the recess of the printing operation, so as to prevent ink in the nozzles from being dried. In the case where a nozzle is clogged, the inner pressure of the head cap 210 covering the print head 36 is reduced by suction of the air with a non-illustrated pump. This sucks out the ink clogging the nozzle and solves the problem of the clogged nozzle.

Figure 16:
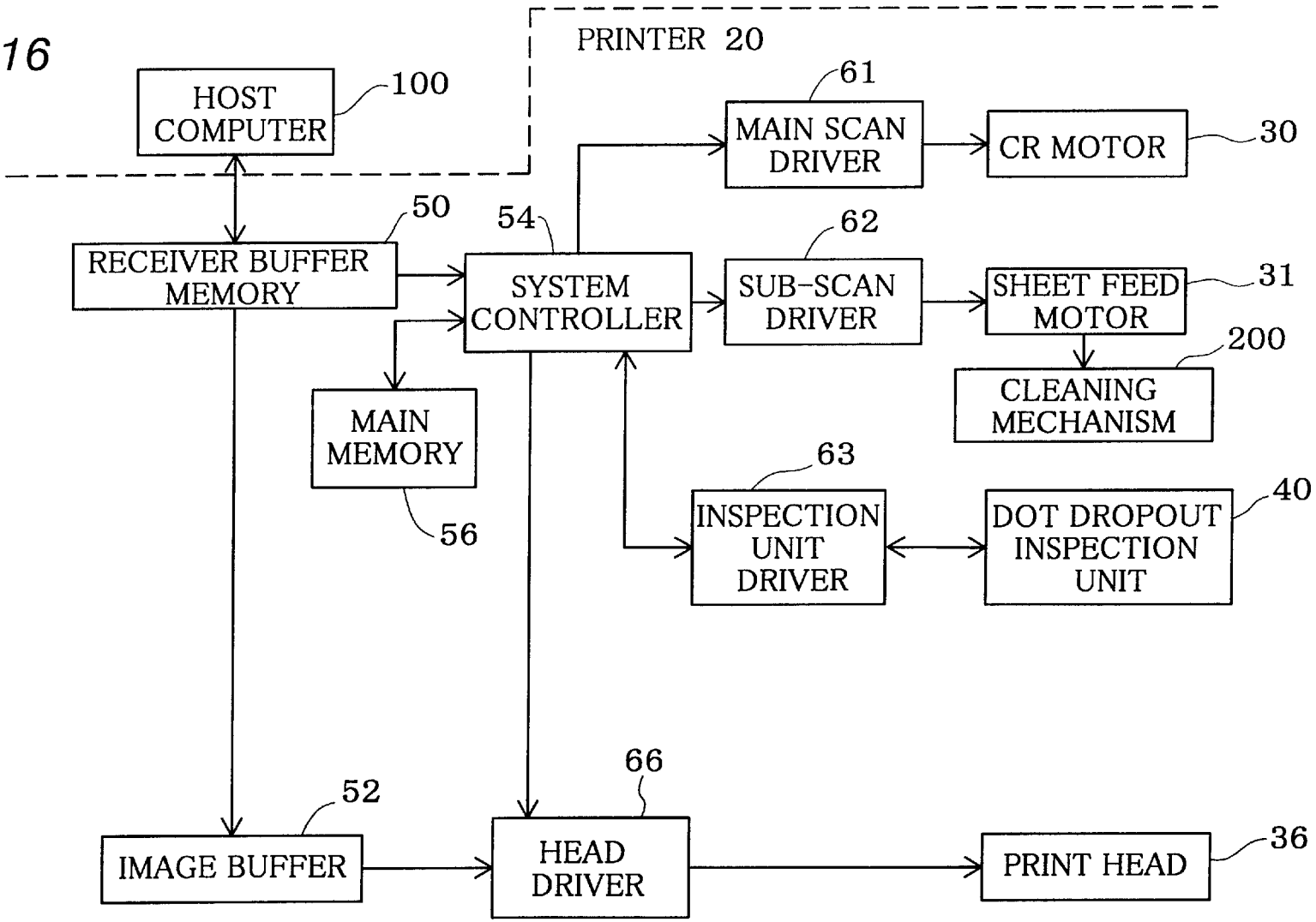
FIG. 16 is a block diagram showing the electrical structure of the printer 20.

FIG. 16 is a block diagram illustrating the electrical structure of the printer 20. The printer 20 includes a receiver buffer memory 50 that receives signals supplied from a host computer 100, an image buffer 52 that stores print data, a system controller 54 that controls the operations of the whole printer 20, and a main memory 56. The system controller 54 is connected with a main scan driver 61 that drives the carriage motor 30, a sub-scan driver 62 that drives the sheet feed motor 31, an inspection unit driver 63 that drives the dot dropout inspection unit 40, and a head driver 66 that drives the print head 36.

A printer driver (not shown) in the host computer 100 determines a variety of parameters that define the printing operation in a print mode specified by the user (for example, a high-speed print mode or a high-quality print mode). The printer driver also generates print data to be printed in the specified print mode based on the predetermined parameters, and transfers the print data to the printer 20. The transferred print data are temporarily stored in the receiver buffer memory 50. In the printer 20, the system controller 54 reads required pieces of information from the print data stored in the receiver buffer memory 50, and outputs control signals to the respective drivers based on the read-out pieces of information.

The print data received by the receiver buffer memory 50 are decomposed into a plurality of color components. The print data of the plural color components are stored in the image buffer 52. The head driver 66 reads the print data of each color component from the image buffer 52 in response to the control signal output from the system controller 54, and drives a nozzle array of each color formed in the print head 36 according to the read-out print data of each color component. The cleaning mechanism 200 comprises the head cap 210 and a non-illustrated pump. In the case where a nozzle is clogged, the head cap 210 is lift to cover the print head 36 and the non-illustrated pump sucks out the air in the head cap 210. The sheet feed motor 31 lifts the head cap 210 and drives the non-illustrated pump.

Figure 17:
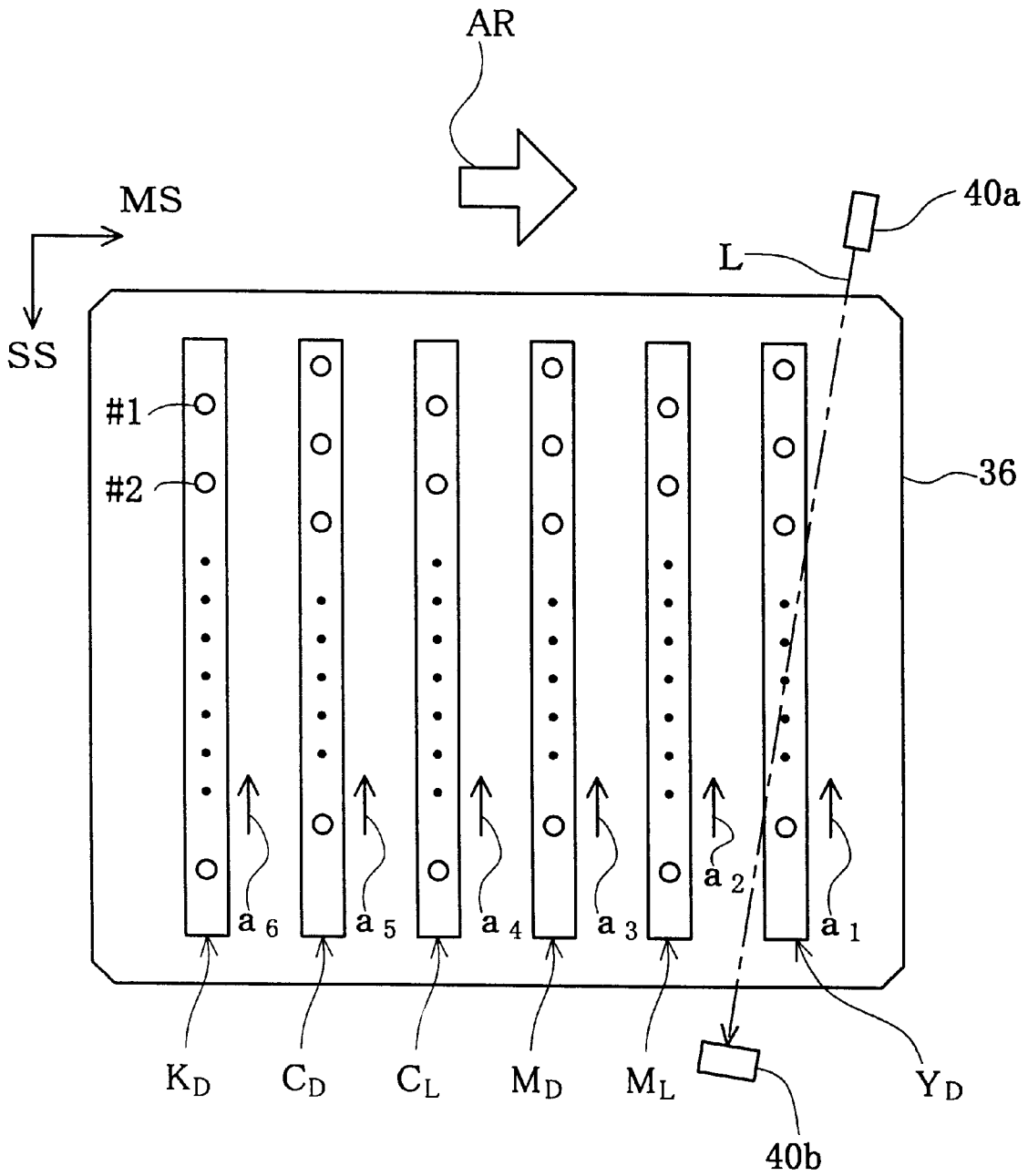
FIG. 17 shows the structure of the dot dropout inspection unit 40 and the principle of its inspection method.

C-2. Structure of Dot Dropout Inspection Unit and Principle of Inspection (1) Structure of Dot Dropout Inspection Unit FIG. 17 shows the structure of the dot dropout inspection unit 40 and the principle of its inspection procedure. The print head 36 shown in FIG. 17 is seen from the bottom side thereof. Nozzle arrays for six colors formed on the print head 36, as well as the light emitting element 40*a* and the light receiving element 40*b* included in the dot dropout inspection unit 40 are shown in FIG. 17.

A black ink nozzle array $K_D$ for ejecting black ink, a deep cyan ink nozzle array $C_D$ for ejecting deep cyan ink, a light cyan ink nozzle array $C_L$ for ejecting light cyan ink, a deep magenta ink nozzle array $M_D$ for ejecting deep magenta ink, a light magenta ink nozzle array $M_L$ for ejecting light magenta ink, and a yellow ink nozzle array $Y_D$ for ejecting yellow ink are formed in the lower surface of the print head 36.

The first capital letter in each symbol representing each nozzle array represents the color of ink. The subscript $_D$ represents ink of a relatively high density, and the subscript $_L$ represents ink of a relatively low density. The subscript $_D$ in the yellow ink nozzle array $Y_D$ means that substantially equi-volume mixture of the yellow ink ejected from this nozzle array, the deep cyan ink, and the deep magenta ink gives a gray color. The subscript $_D$ in the black ink nozzle array $K_D$ means that the black ink ejected from this nozzle array is not gray in color but is black in color having the density of 100%.

A plurality of nozzles included in each nozzle array are aligned in a sub-scanning direction SS. In the course of the printing operation, while the print head 36 together with the carriage 28 (see FIG. 14) shifts in a main scanning direction MS, an ink droplet is ejected from each nozzle.

The light emitting element 40*a* is a laser that emits a light flux L having an outer diameter of not greater than approximately 1 mm. The laser beam L is emitted in a direction a little inclined to the sub-scanning direction SS and is received by the light receiving element 40*b* as shown in FIG. 17.

(2) Principle of Dot Dropout Inspection

Figure 18:
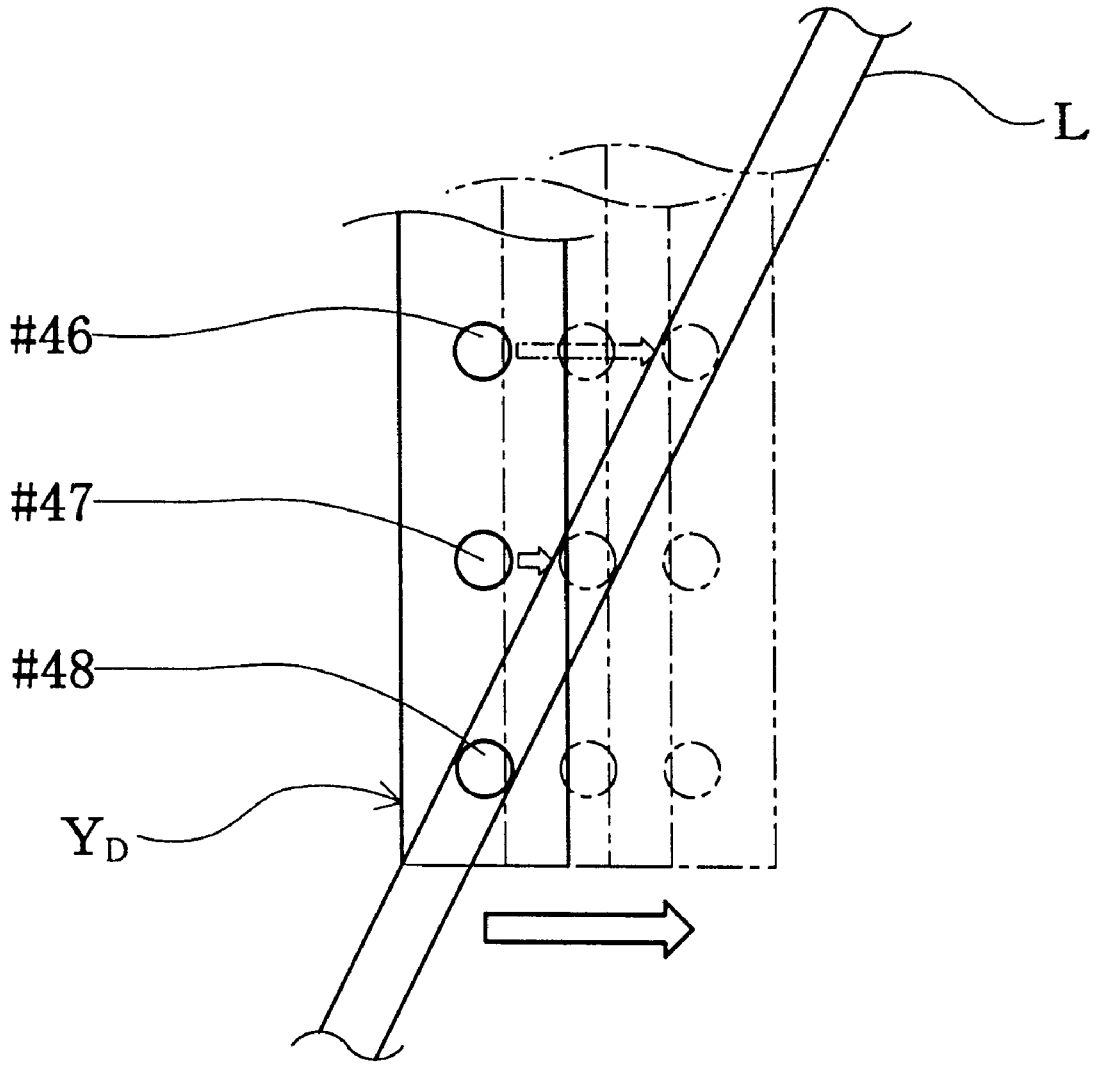
FIG. 18 shows the principle of the method of dot dropout inspection.

FIG. 18 is an enlarged view illustrating the principle of the procedure of the dot dropout inspection. The process of the dot dropout inspection first shifts the print head 36 at a fixed speed as shown by an arrow AR in FIG. 17 to make the nozzle arrays sequentially, the yellow ink nozzle array $Y_D$ first, approach to the laser beam L. With a shift of the print head 36, the laser beam L (relatively) passes through below each nozzle sequentially from the rear end of the yellow ink nozzle array $Y_D$, that is, in the sequence of nozzles #48, #47, #46, . . . In this embodiment, it is assumed that the nozzle array of each color formed in the print head 36 includes forty-eight nozzles #1 through #48.

After passing through the nozzle #1 located at the front end of the yellow ink nozzle array $Y_D$, the laser beam L passes through below each nozzle sequentially from the rear end of the light magenta ink nozzle array $L_M$, that is, in the sequence of nozzles #48, #47, #46, . . . In a similar manner, the laser beam L (relatively) passes through below each nozzle sequentially to the nozzle #1 placed at the front end of the black ink nozzle array $K_D$ as shown by arrows $a_1$, $a_2$, $a_3$, . . . in FIG. 17.

An instruction to eject an ink droplet has been output to each nozzle for a fixed time period before and after the timing when an ink droplet passes through the laser beam L that is located immediately below the nozzle. More concretely, the instruction to eject an ink droplet has been output for a sufficient time period, in order to enable an ink droplet to pass through an intersection of an area of ink droplet locus and the laser beam L.

The term 'area of ink droplet locus' means the area of the expected locus of an ink droplet that has a predetermined size and is ejected from the nozzle. Since the 'area of ink droplet locus' is based on the expectation, the actual locus of the ink droplet may deviate from this area of ink droplet locus. In this case, the ink droplet may not sufficiently intercept the light beam emitted from the inspection unit, although the (expected) area of ink droplet locus intersects the laser beam L. In the case where the ink droplet is normally ejected from the nozzle to an expected area below the nozzle, however, the ejected ink droplet somehow intercepts the laser beam L in the course thereof.

When the ink droplet is normally ejected from the nozzle to the expected area below the nozzle, the ejected ink droplet intercepts the laser beam L in the course thereof. Accordingly the light received by the light receiving element 40*b* is temporarily cut off or at least reduced, and the quantity of light received becomes less than a predetermined threshold value. In this case, it is determined that the nozzle is not clogged. In the case where the quantity of light received by the light receiving element 40*b* during the driving period of a certain nozzle is not less than the predetermined threshold value, on the other hand, it is determined that the certain nozzle might be clogged.

As described above, all the nozzles have been inspected for the ejection of ink droplets before the nozzle #1 that is located at the front end of the black ink nozzle array $K_D$ passes through above the laser beam L. One ink droplet may not be sufficient for the definite determination of whether or not the ink droplet intercepts the laser beam L. It is accordingly preferable that several ink droplets are ejected with regard to each nozzle.

This method of inspection determines the clogging or non-clogging state of each nozzle (that is, the presence or absence of a dot dropout) by detecting the ink droplet in flight. This advantageously completes the inspection for a relatively short time period.

This inspection may be performed while the print head 36 is shifted either forward or backward in the main scanning direction. In this embodiment, the print head 36 on the carriage 28 is dragged by means of the traction belt 32 driven by the step motor 30 and shifted in the main scanning direction along the guide rails 34 (see FIG. 14). In one possible modification, a head scan drive unit for inspection may be provided independently. The printing apparatus is required to have a feeding mechanism that moves at least one of the nozzles and the inspection unit, in order to change the relative positions thereof. The combined use of an identical mechanism for the main scan of the print head in the process of printing and for the scan in the process of inspection desirably reduces the size of the whole printing apparatus. The separate unit for the scan of the print head in the process of inspection, on the other hand, can be selected for the optimum inspection, for example, the highly accurate positioning.

In this method of inspection, the relative positions of the inspection unit and the plurality of nozzle arrays, which are the objects of the inspection, are preferably set to prevent the areas of ink droplet locus with regard to any two or more nozzles from simultaneously intersecting the laser beam L. Namely it is preferable that the laser beam L does not interfere with the passages of ink droplets ejected from any set of plural nozzles. Some divisions as discussed below are accordingly required when the relationship among the form of the laser beam L, the direction of the optical axis, the nozzle pitch and the interval of the adjoining nozzle arrays cause the laser beam L to interfere with the passages of ink droplets ejected from a plurality of nozzles.

C-3. Grouping Nozzles and Inspecting each Inspection Group for Ejection

Figure 19:
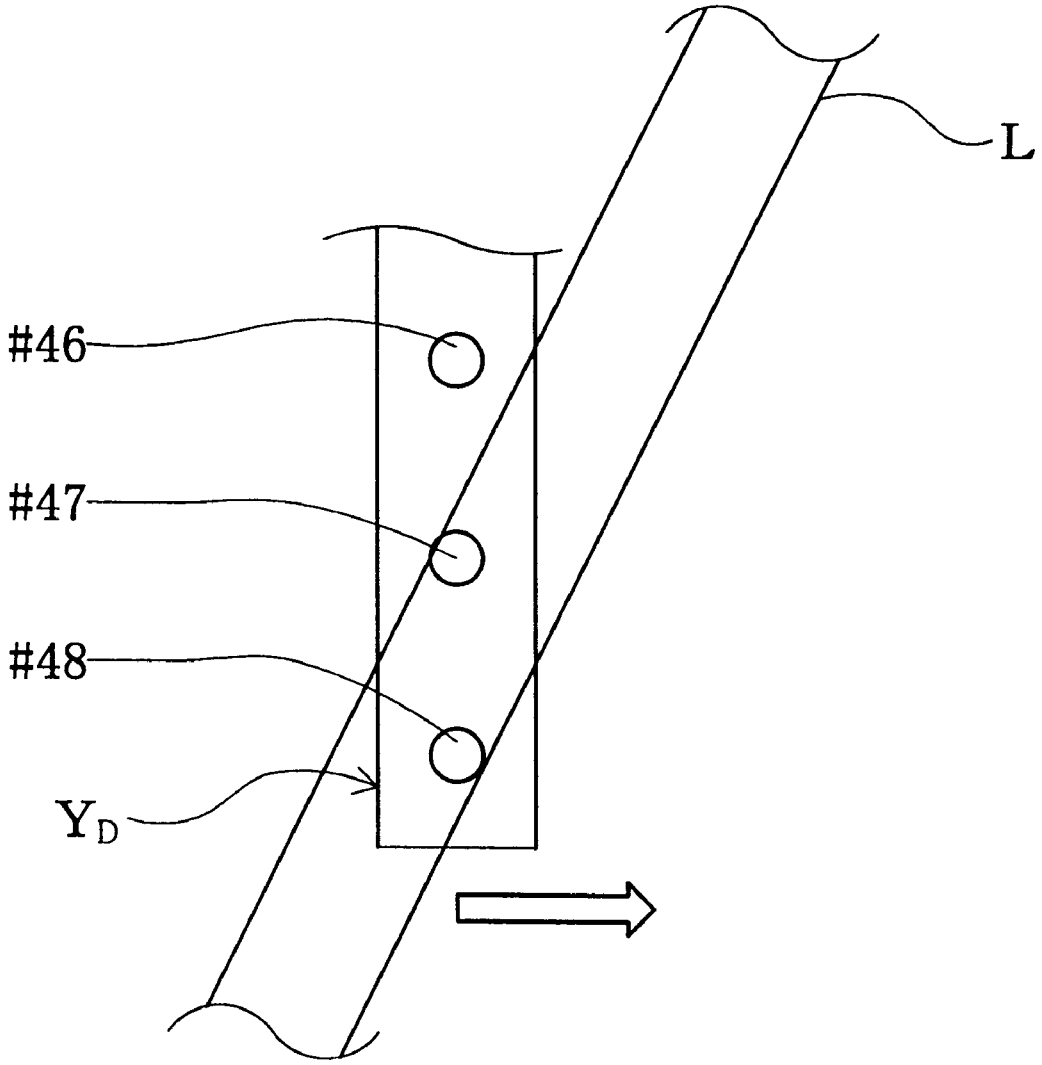
FIG. 19 shows the relationship between the area of ink droplet locus of a laser beam L and the nozzles.

FIG. 19 shows the relationship between the laser beam L and the nozzles. The above method of inspection can not be applied directly when the relationship among the form of the laser beam L, the direction of the optical axis, the nozzle pitch and the interval of the adjoining nozzle arrays cause the laser beam L to interfere with the areas of ink droplet locus with regard to a plurality of nozzles as shown in FIG. 19. In this case, ink droplets ejected from the plurality of nozzles simultaneously pass through the laser beam L. An abnormal nozzle that does not properly eject an ink droplet may thus be determined mistakenly to be normal, because of the presence of an ink droplet ejected from another nozzle. In order to solve this problem, the technique of the third embodiment divides all the nozzles formed on the print head 36 into six inspection groups and inspects each inspection group for ejection. This arrangement effectively prevents the areas of ink droplet locus with regard to any two or more nozzles, which are the objects of the inspection, from simultaneously intersecting the laser beam L.

Figure 20:
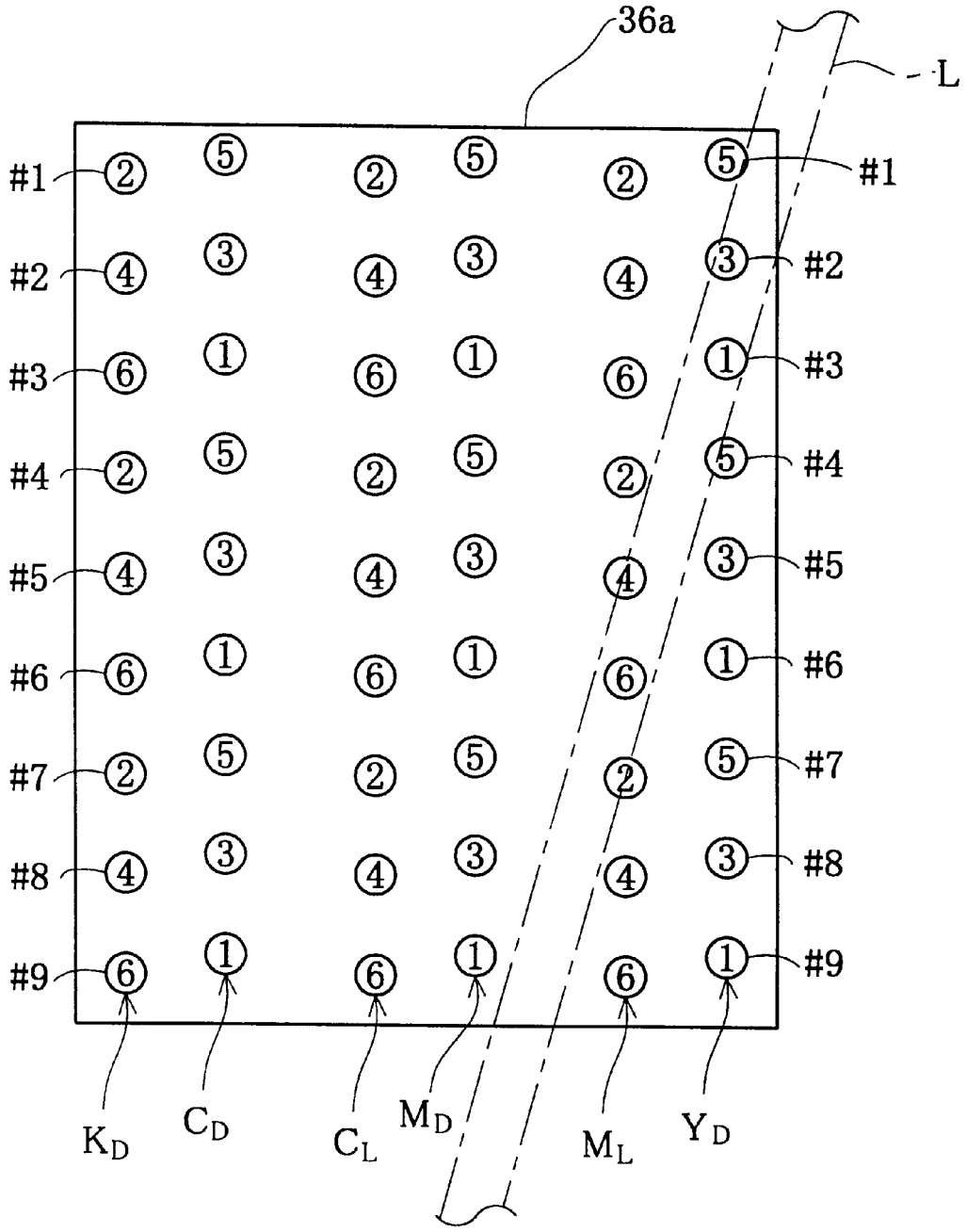
FIG. 20 shows a state of grouping nozzles on a print head 36*a;*

FIG. 20 shows a state of grouping nozzles on a print head 36*a*. For the purpose of simplicity, the explanation refers to the print head 36*a* having six nozzle arrays, each including nine nozzles, instead of the print head 36 having six nozzle arrays, each including forty eight nozzles. In FIG. 20, the encircled numeral allocated to each nozzle denotes one of inspection groups 1 through 6, which the nozzle belongs to. The structure of the print head 36*a* is identical with the structure of the print head 36, except that the number of nozzles included in each nozzle array is reduced from 48 to 9. With the feed of the print head 36*a,* the nozzle #9 in the nozzle array $Y_D$ first passes through the laser beam L and the nozzle #1 in the nozzle array $K_D$ last passes through the laser beam L, in the same manner as described above. FIG. 20 simply shows the state of grouping the nozzles and does not reflect the actual dimensions of the nozzle pitch and the interval of the adjoining nozzle arrays.

The 9×6 nozzles are divided into six inspection groups, each including nine nozzles. The first inspection group includes the nozzles #9, #6, and #3 in the nozzle arrays $Y_D$, $M_D$, and $C_D$. The third inspection group includes the nozzles #8, #5, and #2 in the nozzle arrays $Y_D$, $M_D$, and $C_D$. The fifth inspection group includes the nozzles #7, #4, and #1 in the nozzle arrays $Y_D$, $M_D$, and $C_D$. These three inspection groups cover all the nozzles included in the nozzle arrays $Y_D$, $M_D$, and $C_D$. The second inspection group includes #1, #4, and #7 in the nozzle arrays $K_D$, $C_L$, and $M_L$. The fourth nozzle array includes #2, #5, and #8 in the nozzle arrays $K_D$, $C_L$, and $M_L$. The sixth nozzle array includes #3, #6, and #9 in the nozzle arrays $K_D$, $C_L$, and $M_L$. These three inspection groups cover all the nozzles included in the nozzle arrays $K_D$, $C_L$, and $M_L$.

In the arrangement of dividing the respective nozzles into several inspection groups, while the area of ink droplet locus with regard to a certain nozzle included in one inspection group intersects the laser beam, the area of ink droplet locus with regard to another nozzle included in the same inspection group does not simultaneously intersect the laser beam. In the example of FIG. 20, the area of ink droplet locus with regard to the nozzle #3 in the nozzle array $Y_D$, which belongs to the first inspection group, intersects the laser beam L. The area of ink droplet locus with regard to the nozzle #6 in the nozzle array $Y_D$, which also belongs to the first inspection group and previously intersected the laser beam L, does not currently intersect the laser beam L. In a similar manner, the area of ink droplet locus with regard to the nozzle #9 in the nozzle array $M_D$, which also belongs to the first inspection group and will subsequently intersect the laser beam L, does not currently intersect the laser beam L.

Figure 21:
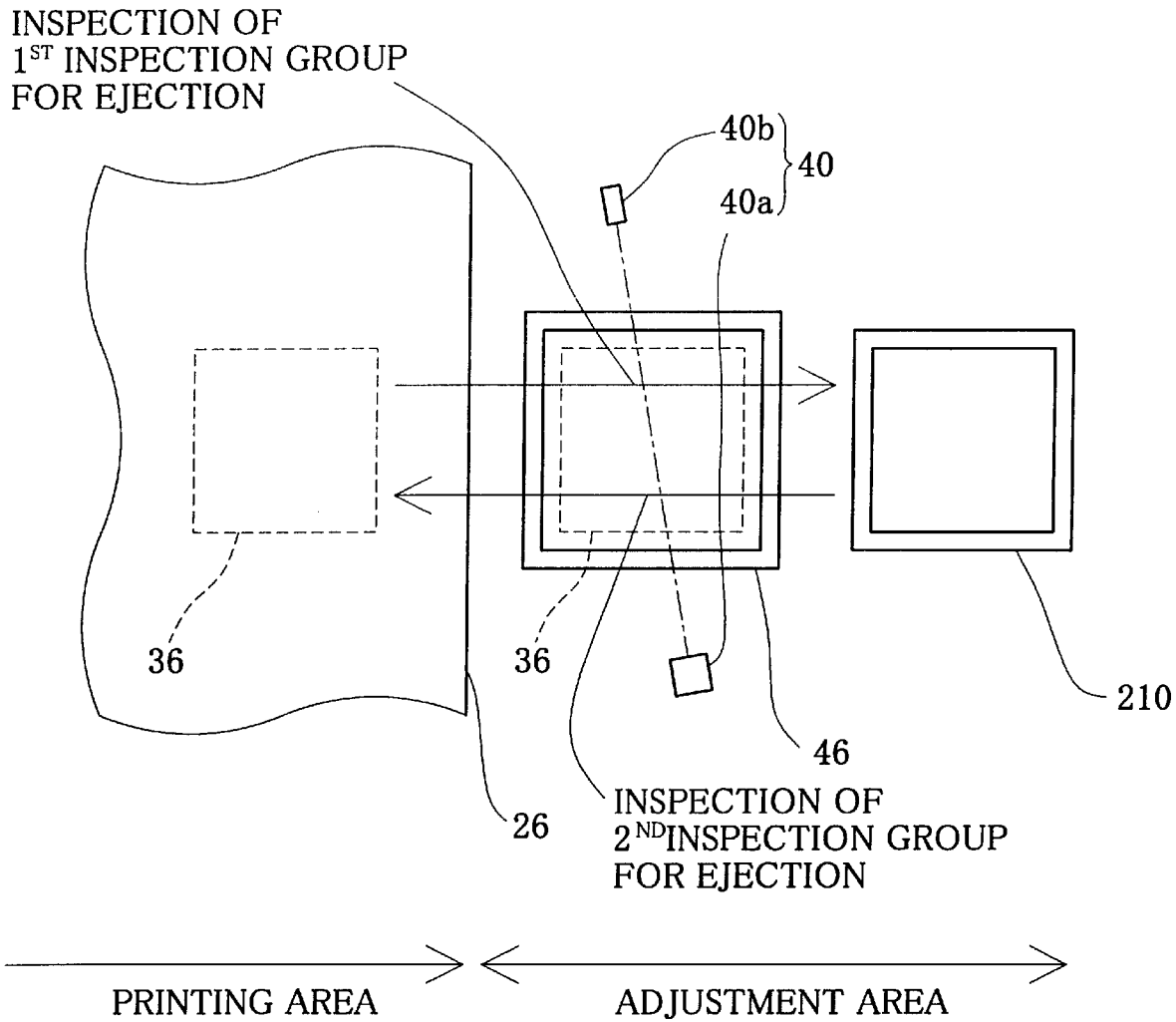
FIG. 21 shows inspection of first and second inspection groups for ejection of ink droplets in an adjustment area.

FIG. 21 shows a process of inspecting the first and the second inspection groups for ejection of ink droplets in the adjustment area. When the print head 36*a* enters the adjustment area after the completion of a first printing operation in the printing area by the first pass of the main scan, the first inspection group is inspected for ejection of ink droplets above the waste ink tray 46 and the dot dropout inspection unit 40. When the print head 36*a,* which has just passed through above the dot dropout inspection unit 40, turns at a stand-by position on the head cap 210 towards the printing area and again passes through above the dot dropout inspection unit 40, the second inspection group is inspected for ejection of ink droplets above the waste ink tray 46. When the print head 36*a* again enters the adjustment area after the completion of a next printing operation in the printing area, the third and the fourth inspection groups are inspected for ejection of ink droplets. In a similar manner, the fifth and the sixth inspection groups are inspected for ejection of ink droplets after a subsequent printing operation in the printing area. The first and the second inspection groups are then inspected again for ejection of ink droplets. This series of inspections is repeatedly carried out for the sequential inspection groups.

One of the inspection groups is inspected while one pass of the print head in the main scanning direction is completed. This series of inspections is repeatedly carried out. Two inspection groups are inspected for ejection during one set of forward and backward passes of the main scan of the print head 36*a*. All the nozzles on the print head 36*a* are accordingly inspected for ejection during three sets of forward and backward passes of the main scan of the print head 36*a*.

Like the example discussed above, in the case of the print head 36 having the six nozzle arrays, each including forty-eight nozzles, each inspection group includes every third nozzles in every other nozzle array like $Y_D$, $M_D$, $C_D$ or $K_D$, $C_L$, $M_L$. Each inspection group is inspected for ejection of ink droplets in the course of the forward pass and the backward pass of the main scan. The system controller 54 (see FIG. 16) controls the carriage motor 30, the dot dropout inspection unit 40, and the print head 36 via the respective drivers, so as to attain this series of operations.

C-4. Inspection for Dot Dropout

Figure 22:
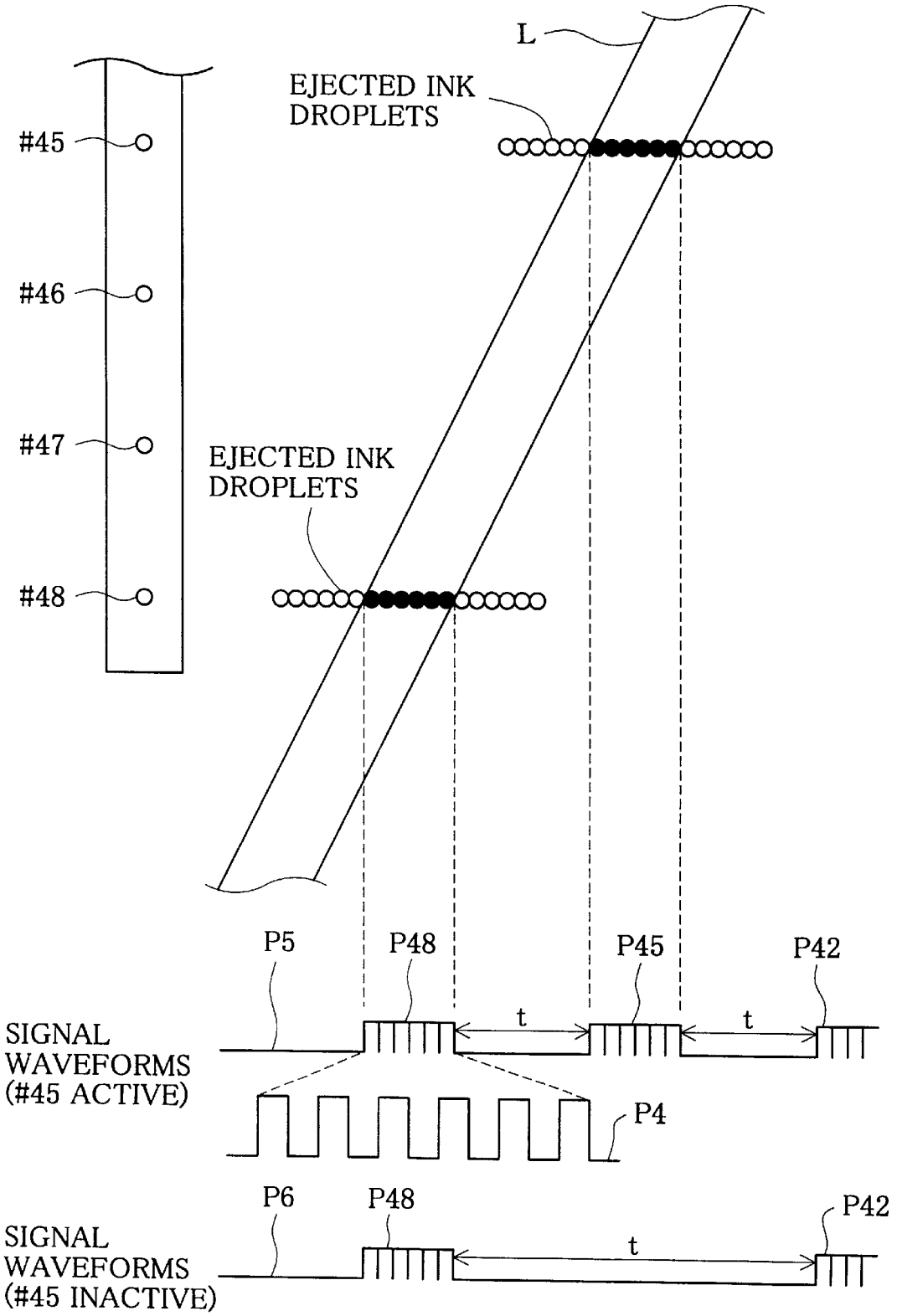
FIG. 22 shows ink droplets ejected within the laser beam L and signal waveforms for detecting the ink droplets.

FIG. 22 shows ink droplets ejected in the laser beam L and the signal waveforms that detect the ink droplets. In the course of the inspection of each inspection group for ejection, ink droplets are continuously ejected from the respective nozzles included in the inspection group before the intersection of the area of ink droplet locus with regard to a first nozzle in the inspection group and the laser beam L and after the intersection of the area of ink droplet locus with regard to a last nozzle in the inspection group and the laser beam L. This is to ensure the passage of some ink droplets through the laser beam even in the event that the actual direction of ejecting ink droplets is deviated from the expected direction. The scan speed of the print head 36 is set to allow six ink droplets ejected from each nozzle to pass through the laser beam L in a time period while the area of ink droplet locus with regard to the nozzle passes through the laser beam L.

When six ink droplets intercept the laser beam L, the light receiving element 40*b* outputs six signal waveforms P4 to the system controller 54 as shown in the middle signal chart in the upper signal chart in the bottom of FIG. 22. In the case where all the nozzles work normally, plural sets of signal waveforms, P48, P45, P42, each set corresponding to the ink droplets of one nozzle, are output at fixed time intervals t as shown in the upper signal chart P5 in the bottom of FIG. 22. In the case where the nozzle #45 does not work normally, on the other hand, there is no set of signal waveforms P45 corresponding to the ink droplets of the nozzle #45 as shown in the lower signal chart P6 in the bottom of FIG. 22. This extends the time interval t between the rear end of a set of signal waveforms corresponding to the ink droplets of the nozzle #48 and the front end of a next set of signal waveforms P42. In this case, the system controller 54 (see FIG. 16) determines that an abnormal nozzle is present.

C-5. Effects of Third Embodiment

In the configuration of the third embodiment, the optical axis of the laser beam L has a predetermined inclination to the direction of the alignment of each nozzle array. Nozzles can thus be sequentially inspected for ejection with a shift of the print head 36. This arrangement enables the inspection to be carried out within a relatively short time. The technique of this embodiment does not require the repeated shift and stop of the print head every time each nozzle is inspected. This gives little positioning error and ensures the highly accurate inspection.

In the technique of the third embodiment, each inspection group includes every three nozzles in every other nozzle array and is inspected for ejection of ink droplets either in the forward pass or in the backward pass of the main scan. Compared with the conventional technique that simply inspects all the nozzles on the print head, this arrangement ensures the three-fold distance between the closest nozzles included in the same inspection group in the direction of the alignment of each nozzle array and the two-fold interval between the closest nozzle arrays included in the same inspection group. This arrangement effectively prevents the laser beam L from interfering with the passages of ink droplets ejected from any set of plural nozzles even in the case where the laser beam L has a greater diameter or the direction of the optical axis is more inclined as the nozzle pitch or the interval between the adjoining nozzle arrays.

It is preferable that each inspection group includes as many nozzles as possible in the range that fulfills the required conditions. The more nozzles each group includes, the less total numbers of inspection group. A decrease in total number of inspection groups preferably decreases the number of feeds required for inspection of all the nozzles to be inspected, and thereby reduces the total time required for the inspection.

The combination of the nozzles included in each inspection group is not restricted to that satisfying the above conditions. Each inspection group may include every n nozzles (where n is an integer of at least 2) in every m nozzle arrays (where m is an integer of at least 2). The integers n and m are set equal to appropriate values according to the nozzle pitch, the interval between the adjoining nozzle arrays, the form of the laser beam, and the direction of the optical axis. The target of inspection each time is only the nozzles included in one inspection group. This arrangement effectively prevents the laser beam L from interfering with the passages of ink droplets ejected from any set of plural nozzles.

The technique of dividing plural nozzles is not restricted to the above arrangement, as long as ink droplets ejected from any two or more nozzles belonging to the same inspection group do not simultaneously intercept the light beam emitted from the light emitter. Such division enables the respective nozzles included in one inspection group to be inspected for ejection of ink droplets during one feed of the print head or the inspection unit.

The angle of the laser beam inclined to the direction of the alignment of each nozzle array may be set equal to an arbitrary value that is greater than 0 and less than 180 degrees. In the case of the inclination angle equal to 90 degrees, the laser beam simultaneously intersects the areas of ink droplet locus with regard to a plurality of nozzles that are included in different nozzle arrays but are aligned in the main scanning direction. The nozzles aligned in the above manner should thus be divided into different inspection groups. When the inclination angle of the laser beam is other than 90 degrees, however, there is no necessity of dividing the nozzles aligned in the above manner into different inspection groups. This arrangement preferably reduces the total number of inspection groups. This accordingly decreases the number of passes of the main scan required for inspecting all the nozzles and shortens the time of inspection. The inclination angle $\theta$ may be specified preferably as $0<\theta<90$ degrees or more preferably $0<\theta<45$ degrees. The inclination angle of $0<\theta<30$ degrees enables the closer nozzles in the main scanning direction to be included in the same inspection group and favorably increases the number of nozzles included in one inspection group.

C-6. Modification of Third Embodiment

Figure 23:
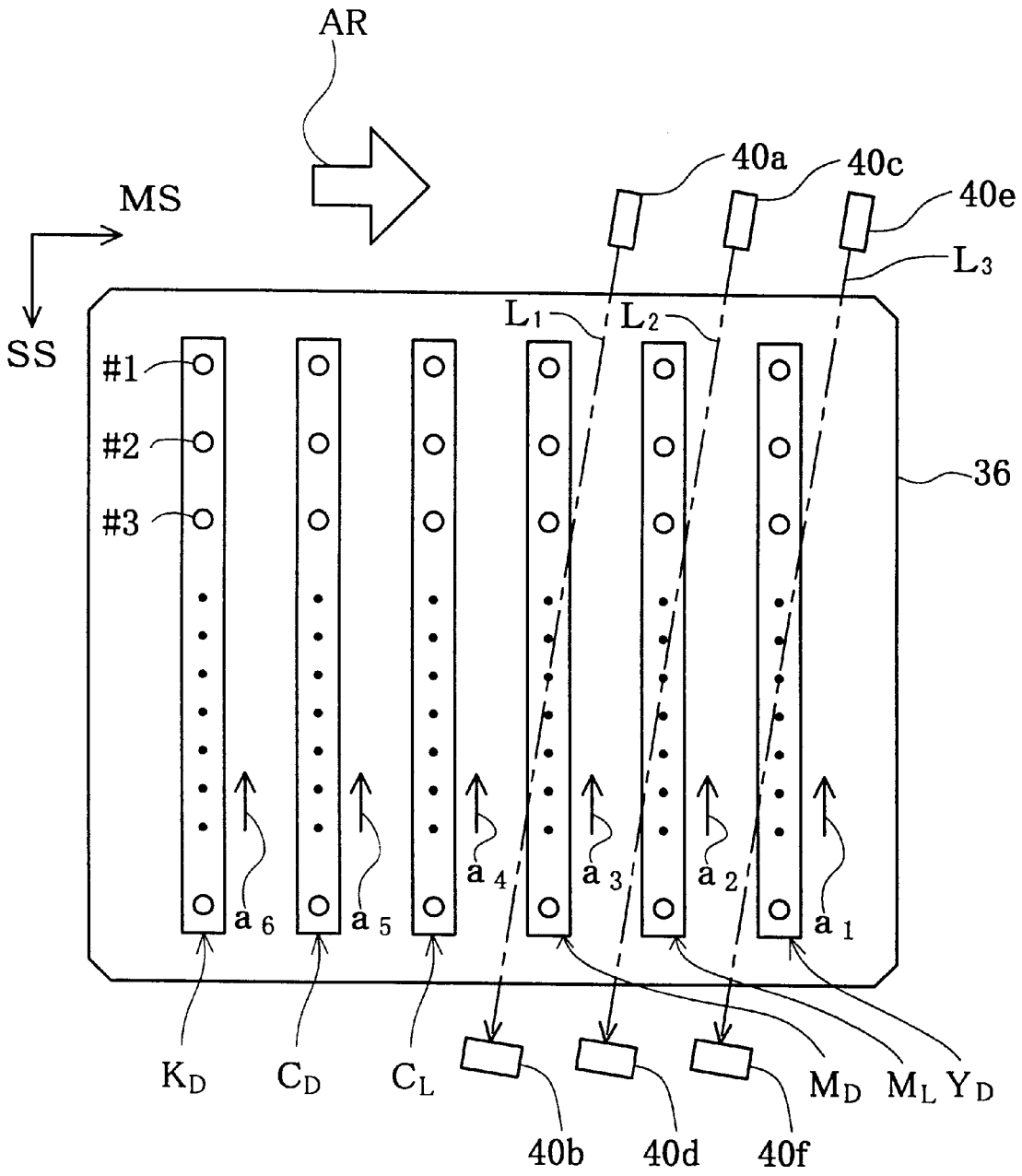
FIG. 23 shows the structure of the dot dropout inspection unit 40 and the principle of its inspection method in one modification of the third embodiment.

FIG. 23 shows the structure of the dot dropout inspection unit 40 and the principle of the inspection procedure thereof in one modification of the third embodiment. Whereas the structure of the third embodiment includes only one set of the light emitting element and the light receiving element, this modified structure includes plural sets of the light emitting elements and the light receiving elements (the light emitting element 40*a* and the light receiving element 40*b*, the light emitting element 40*c* and the light receiving element 40*d*, the light emitting element 40*e* and the light receiving element 40*f*) to emit plural laser beams $L_1$, $L_2$, $L_5$ for detecting ink droplets as shown in FIG. 23. This modified structure enables plural inspection groups corresponding to the number of the sets of the light emitting elements and the light receiving elements (three sets in the example of FIG. 23) to be inspected simultaneously in the course of one pass of the main scan. This arrangement thus shortens the time period required for the dot dropout inspection. In this modified example, there are six inspection groups and three sets of the light emitting elements and the light receiving elements, so that all the nozzles can be inspected for ejection of ink droplets by the forward pass and the backward pass of the main scan.

D. Fourth Embodiment

D-1. Structure of Apparatus

Figure 24:
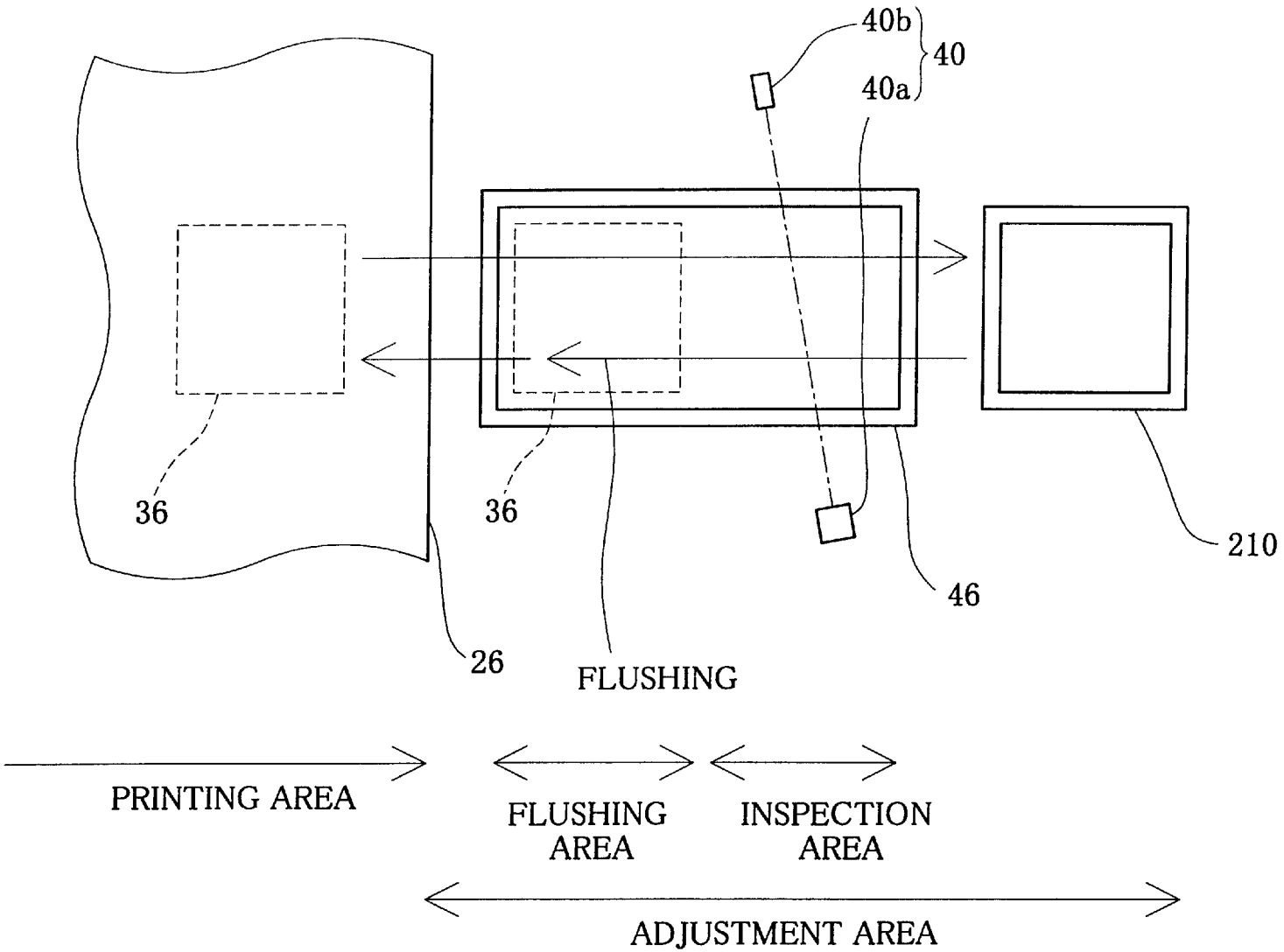
FIG. 24 shows the positional relationship among the dot dropout inspection unit 40, the waste ink tray 46, and the head cap 210 in a printing apparatus of a fourth embodiment.

FIG. 24 shows the arrangement of the dot dropout inspection unit 40, the waste ink tray 46, and the head cap 210 in a printing apparatus of a fourth embodiment according to the present invention. In the printing apparatus of the fourth embodiment, the waste ink tray 46 is wide in the main scanning direction and extends from the position interposed between the light emitting element 40*a* and the light receiving element 40*b* towards the platen plate 26. This arrangement of the fourth embodiment enables the flushing operation to be carried out at a specific position closer to the platen plate 26 than the dot dropout inspection unit 40. The area between the platen plate 26 and the dot dropout inspection unit 40 where the flushing operation is carried out is hereinafter referred to as the 'flushing area'. The area that is located outside the flushing area and where the dot dropout inspection is carried out is hereinafter referred to as the 'inspection area'.

In the printing apparatus of the fourth embodiment, the diameter of the laser beam L is sufficiently narrow relative to the nozzle pitch, and the inclination of the optical axis is sufficiently large relative to the diameter of the laser beam L. As in the case of FIG. 18, this arrangement effectively prevents the areas of ink droplet locus with regard to the adjoining nozzles in the same nozzle array from simultaneously intersecting the laser beam L. The mechanical structure of the printing apparatus of the fourth embodiment is similar to that of the third embodiment, except the above differences.

D-2. Grouping Nozzles

Figure 25:
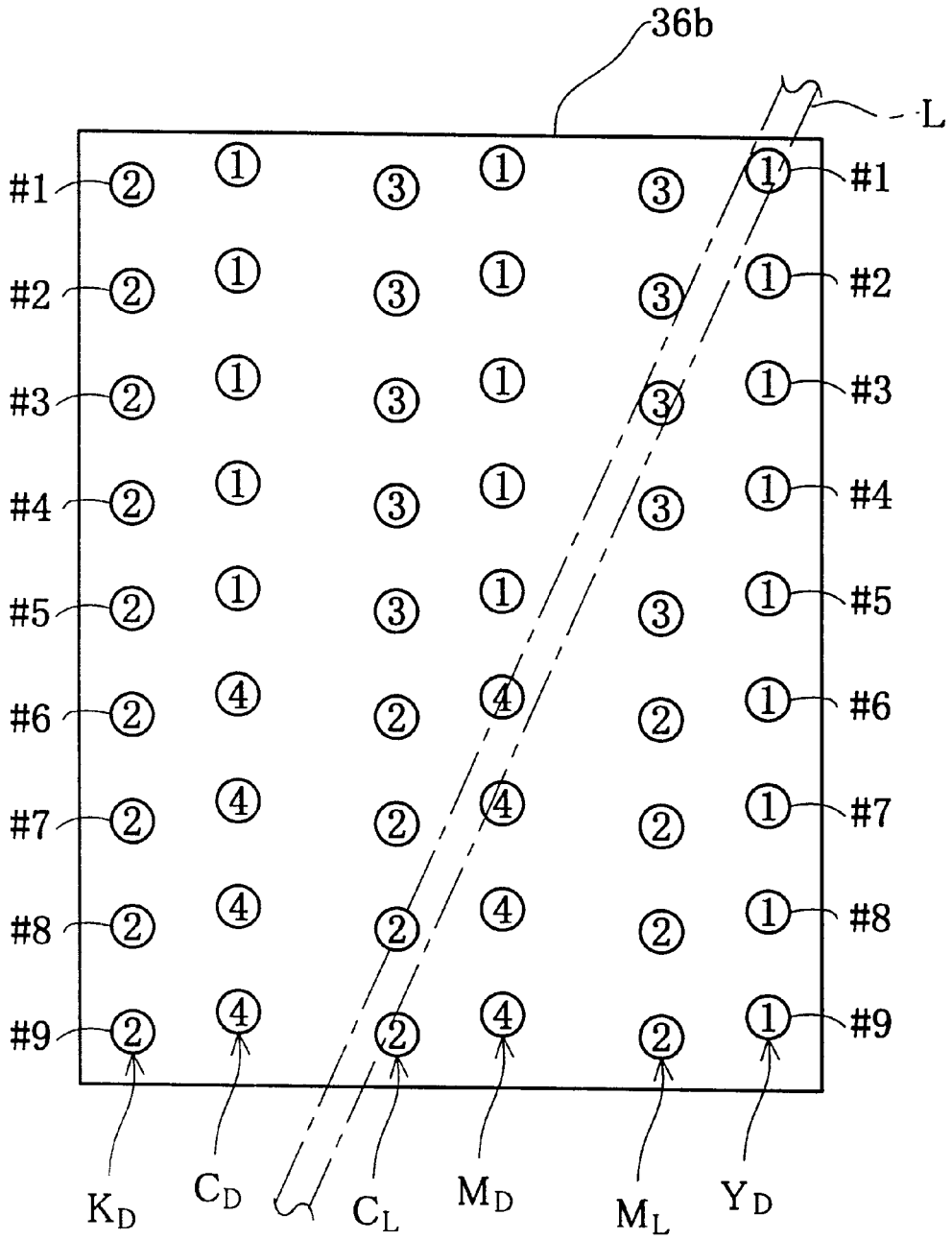
FIG. 25 shows a state of grouping nozzles in the fourth embodiment.

FIG. 25 shows a state of grouping nozzles in the fourth embodiment. For the purpose of simplicity, the explanation refers to a print head 36*b* having six nozzle arrays, each including nine nozzles. In FIG. 25, the encircled numeral allocated to each nozzle denotes one of inspection groups 1 through 4, which the nozzle belongs to. The structure of the print head 36*b* is similar to the structure of the print head 36*a* of the third embodiment, except the technique applied to divide nozzles into inspection groups.

Figure 26:
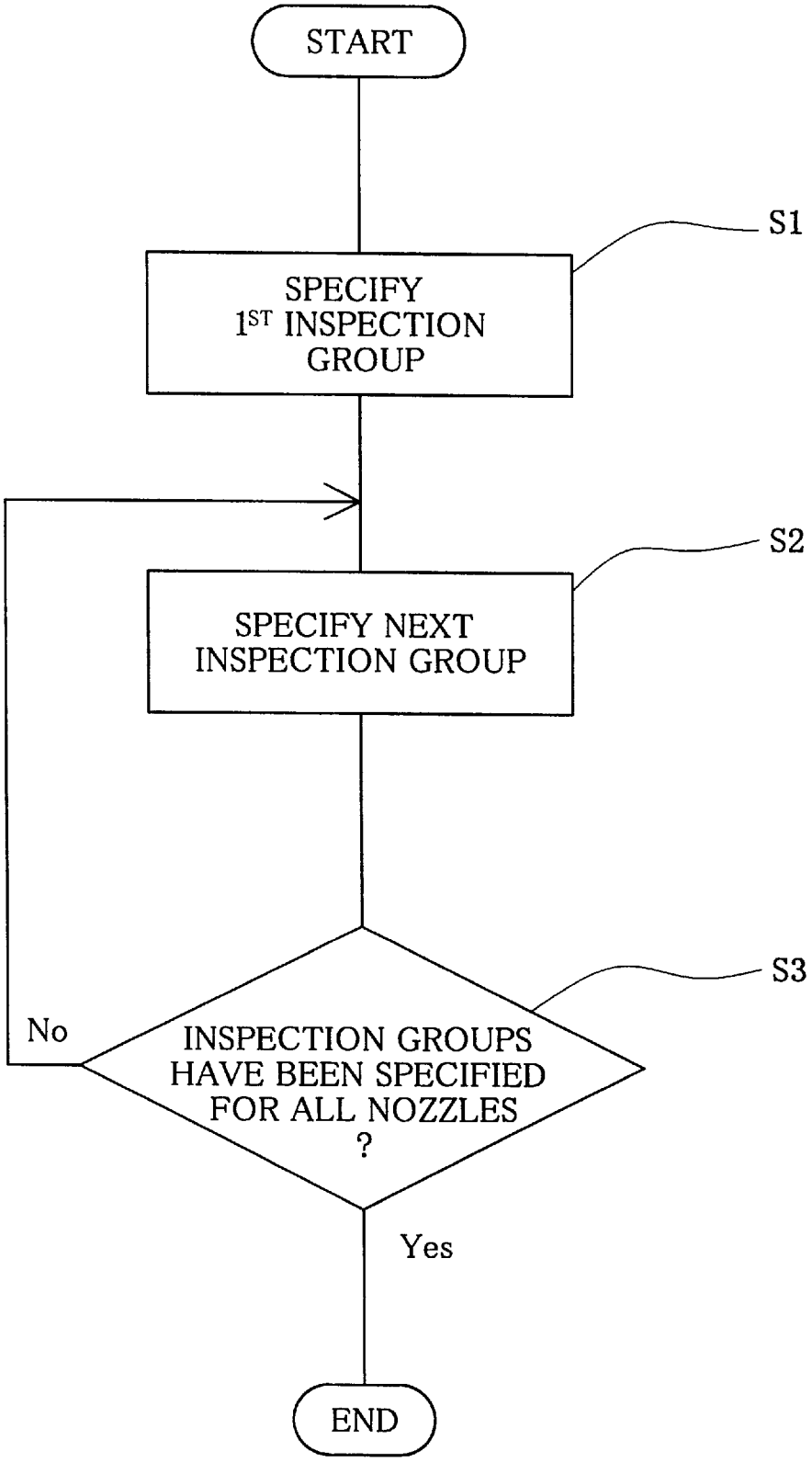
FIG. 26 is a flowchart showing a routine of grouping inspection groups.

FIG. 26 is a flowchart showing a process of specifying the inspection groups. The 9×6 nozzles on the print head are divided into four inspection groups according to the procedure discussed below with FIG. 26.

The processing of step S1 selects 'nozzles having the areas of ink droplet locus that do not intersect the laser beam L simultaneously with the areas of ink droplet locus with regard to any other nozzles' and 'one among at least two nozzles having the areas of ink droplet locus that intersect the laser beam L simultaneously' out of the nozzles on the print head, and specify the selected nozzles as a first inspection group.

The processing of step S2 selects 'nozzles having the areas of ink droplet locus that do not intersect the laser beam L simultaneously with the areas of ink droplet locus with regard to any other nozzles' and 'one among at least two nozzles having the areas of ink droplet locus that intersect the laser beam L simultaneously' out of the 'nozzles that have not yet been selected as the nozzles included in any inspection groups', and specify the selected nozzles as a second inspection group.

At step S3, it is determined whether or not all nozzles are assigned to the inspection group that the nozzle belongs to. In the case of the presence of the non-assigned nozzles, the processing of step S2 is repeated.

The inspection groups 1 through 4 shown in FIG. 25 are specified in this manner. In the arrangement of FIG. 25, while the area of ink droplet locus with regard to a certain nozzle included in one inspection group intersects the laser beam, the area of ink droplet locus with regard to another nozzle included in the same inspection group does not simultaneously intersect the laser beam. In the example of FIG. 25, the area of ink droplet locus with regard to the nozzle #1 in the nozzle array $Y_D$ intersects the laser beam L.

The area of ink droplet locus with regard to the nozzle #2 in the nozzle array $Y_D$, which previously intersected the laser beam L, does not currently intersect the laser beam L. In a similar manner, the area of ink droplet locus with regard to the nozzle #5 in the nozzle array $M_D$, which will subsequently intersect the laser beam L, does not currently intersect the laser beam L.

D-3. Relation among Printing, Dot Dropout Inspection, and Flushing

Figure 27:
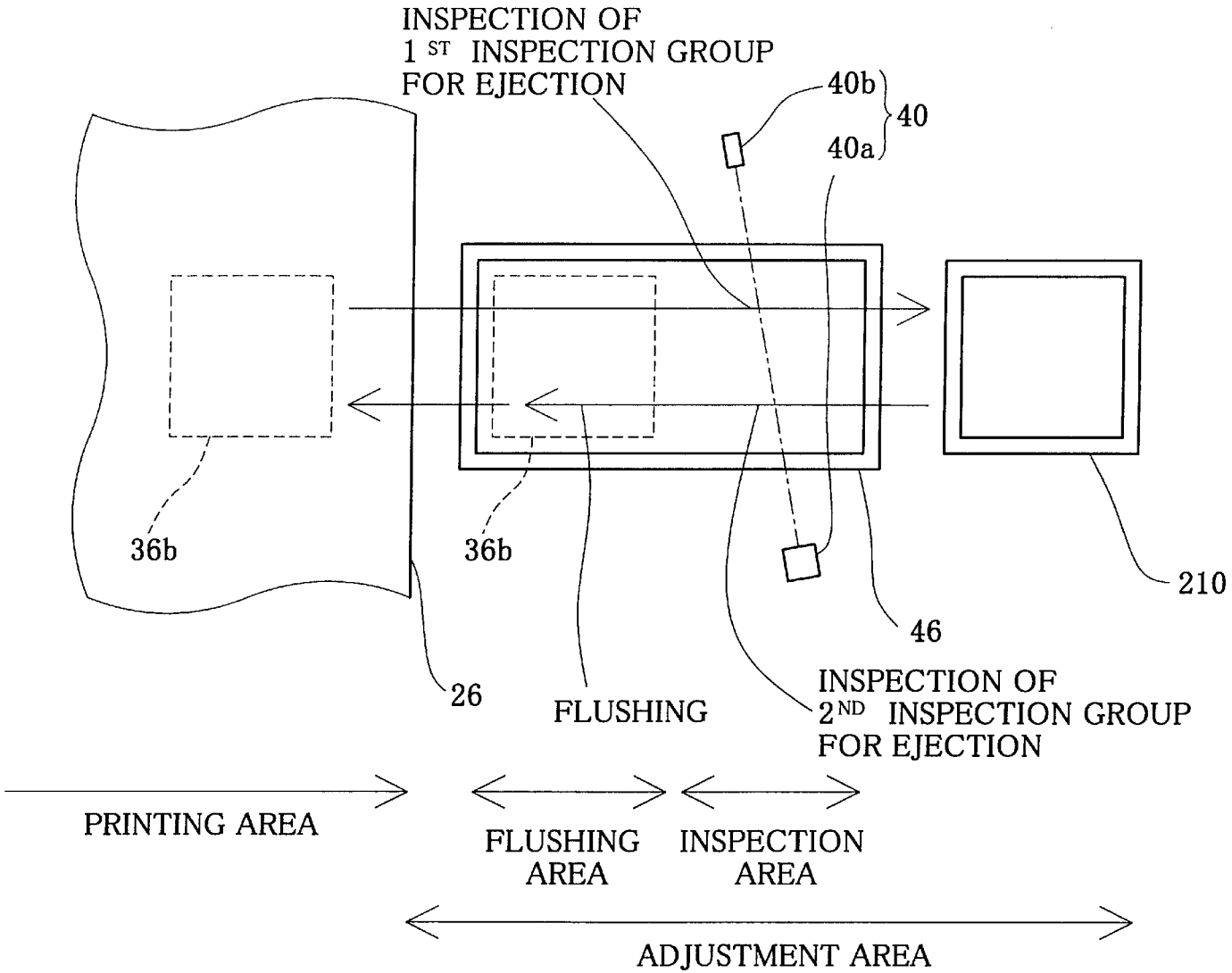
FIG. 27 shows the inspection for ejection of ink droplets and the flushing operation in the adjustment area.

FIG. 27 shows the relationship between the inspection for ejection of ink droplets and the flushing operation in the adjustment area. When the print head 36*b* enters the adjustment area after the completion of a printing operation in the printing area by a first pass of the main scan, the print head 36*b* passes by the flushing area and the first inspection group is inspected for ejection of ink droplets in the inspection area. When the print head 36*b* turns at a stand-by position on the head cap 210 and again passes through above the dot dropout inspection unit 40 (the inspection area), the second inspection group is inspected for ejection of ink droplets. The flushing operation, if necessary, is subsequently carried out in the flushing area. The print head 36 then moves to the printing area. In a similar manner to that discussed in the third embodiment, the other inspection groups are successively inspected for ejection of ink droplets. The flushing operation, if necessary, is carried out in the flushing area prior to a subsequent printing operation in the printing area, after the print head 36 turns at the stand-by position on the head cap 210 and the inspection for ejection is carried out in the inspection area.

D-4. Effects of Fourth Embodiment

The technique of the third embodiment uniformly selects the nozzles at the equal intervals among all the nozzles on the print head to specify the respective inspection groups. The technique of the fourth embodiment, on the other hand, selects the nozzles fulfilling the required conditions among all the nozzles on the print head to specify one inspection group and subsequently selects the nozzles fulfilling the required condition among the rest of the nozzles to specify another inspection group. The arrangement of the fourth embodiment desirably increases the number of nozzles included in each inspection group and thereby decreases the total number of the inspection groups. The number of nozzles included in each inspection group may decrease in the sequence of the specification. The arrangement of this embodiment reduces the number of forward and backward passes of the print head 36 over the dot dropout inspection unit 40, thereby shortening the total time required for the dot dropout inspection. It is preferable to select as many nozzles as possible in each inspection group. In the structure of the fourth embodiment, the flushing area is present between the inspection area and the printing area. The effects of the fourth embodiment are, however, exerted even when the waste ink tray 46 extends in the direction opposite to the platen plate 26 and the flushing area is present outside the inspection area.

When the dot dropout inspection is carried out after the flushing operation, the viscosity of ink increases during the dot dropout inspection. This may result in the insufficient effects of the flushing operation in the process of printing. The technique of the fourth embodiment, however, carries out the dot dropout inspection prior to the flushing operation and starts printing immediately after the flushing operation. This enables printing with the sufficient effects of the flushing operation.

In the structure of the third embodiment, the waste ink tray 46 is disposed between the light emitting element 40*a* and the light receiving element 40*b* of the dot dropout inspection unit 40. The area of the dot dropout inspection is coincident with the area of the flushing operation. When the flushing operation is carried out, the dot dropout inspection is thus not performed either in the forward pass or in the backward pass of the main scan. Namely inspection of only one inspection group for ejection of ink droplets is implemented during one set of the forward and backward passes of the main scan. The sets of the forward and backward passes of the main scan corresponding to the number inspection groups are thus required to inspect all the nozzles on the print head for ejection of ink droplets. This extends the time required for the inspection. The arrangement of the fourth embodiment, however, has the separate flushing area and inspection area. It is accordingly not required to cancel the dot dropout inspection even when the flushing operation is carried out. This arrangement desirably shortens the total time period required to inspect all the nozzles on the print head for ejection.

D-5. Modification of Fourth Embodiment

In the case where printing with the print head is carried out in the printing area both in the forward pass and in the backward pass of the main scan, the print head is fed at a fixed speed both in the forward pass and in the backward pass. When printing is carried out only in the forward pass of the main scan but not in the backward pass, it is desirable to feed the print head at a higher speed in the backward pass, in order to shorten the total printing time. The dot dropout inspection in such cases is described here briefly. This is similar to the arrangement of the fourth embodiment, except the non-execution of printing in the backward pass of the main scan and the feeding speed of the print head in the backward pass.

Figure 28A:
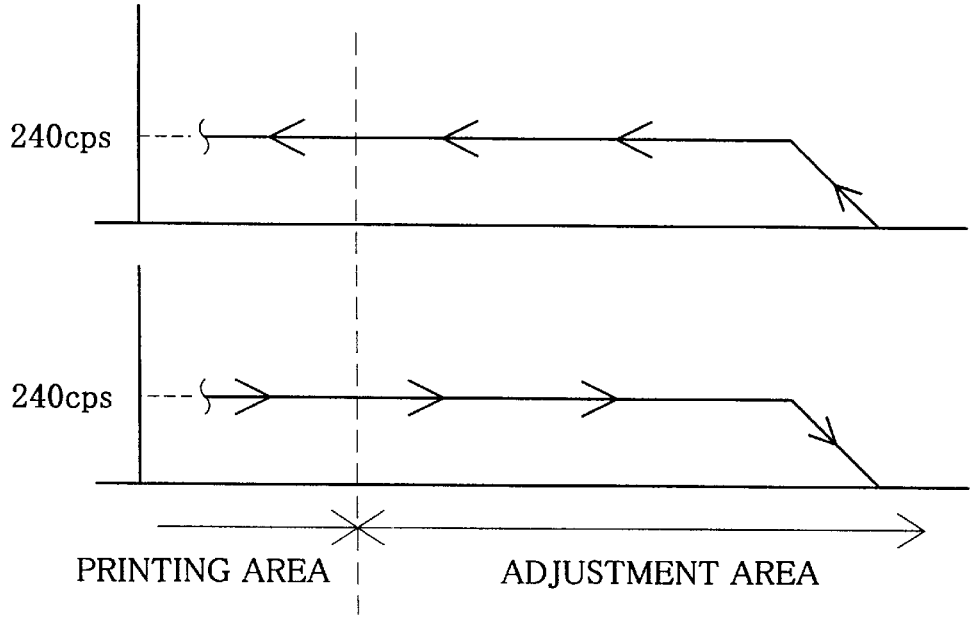
FIG. 28(*a*) and 28(*b*) are graphs showing the feeding speeds of main scan of the print head in the case of bi-directional printing and in the case of mono-directional printing.
Figure 28B:
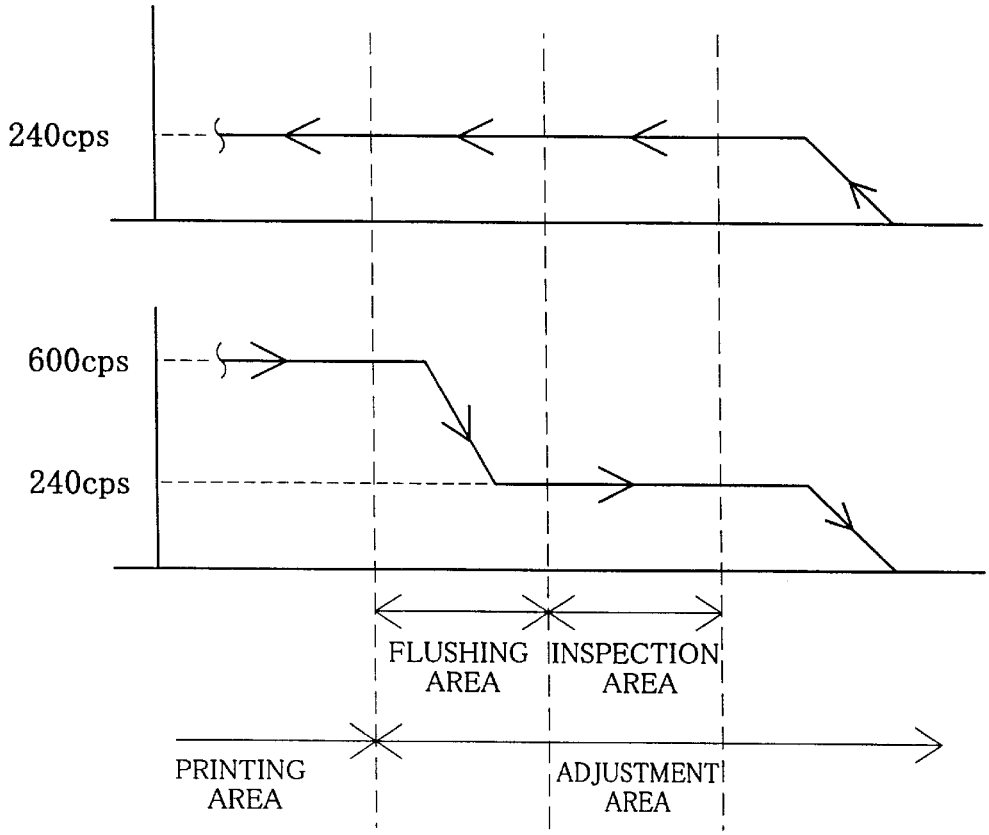

FIG. 28 is graphs showing the feeding speeds of the print head in the process of the main scan in the case of bi-directional printing and in the case of uni-directional printing. In the case of the bi-directional printing that carries out printing both in the forward pass and the backward pass of the main scan as shown in FIG. 28(*a*), the print head is fed at the speed of 240 cps both in the forward pass and the backward pass. In the case of the uni-directional printing that carries out printing only in the forward pass, on the other hand, the print head is first fed at the speed of 600 cps since the low speed scan for the accurate printing is not required in the backward pass. The feeding speed of the print head is lowered before the inspection area and is kept to 240 cps in the inspection area. This ensures the accurate inspection for ejection.

E. Fifth Embodiment

Figure 29:
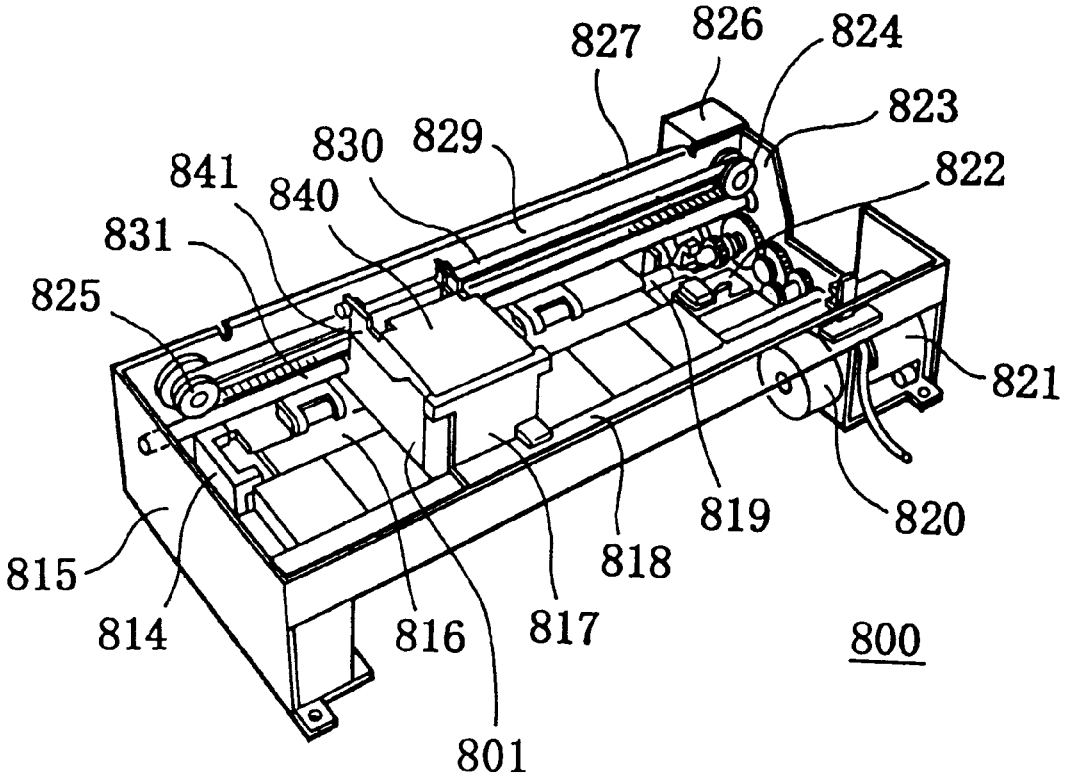
FIG. 29 generally illustrates an ink jet printer in one embodiment according to the present invention.

FIG. 29 generally illustrates an ink jet printer in one embodiment according to the present invention. The following describes a general structure of an ink jet printer with reference to FIG. 29.

An ink jet printer 800 has a box-like carriage 817, on which an ink jet head 801 and an ink reservoir 840 can be mounted. The ink jet head 801 and the ink reservoir 840 are formed, for example, as cartridges, and are detachably set inside the carriage 817 while a top cover 841 of the carriage 817 is open. The carriage 817 is linearly movable in a longitudinal direction (a lateral direction) of a printer framework 827. While the carriage 817 is moving, the ink jet head 801 mounted thereon is driven to carry out printing on a cut sheet 816 being fed.

The reciprocating mechanism of the carriage 817 is described in detail. A front side of the carriage 817 is slidably supported by a guide shaft 831, which is spanned between a left side wall 815 and a right side wall 823 of the printer framework 827. A rear side of the carriage 817 is slidably supported on a top face of a guide plate 818 spanned between the side walls 815 and 823. A driving pulley 824 and a driven pulley 825 are attached to the respective ends of a front wall 829 of the printer framework 827, and a timing belt 830 is spanned between the pulleys 824 and 825. The timing belt 830 is linked with the front side of the carriage 817. When the driving pulley 824 is rotated by a carriage motor 826, which is attached to the front wall 829 of the printer framework 827, the carriage 817 linked with the timing belt 830 moves in the longitudinal direction along the guide shaft 831.

A cap 822 for covering the nozzles on the ink jet head 801 is disposed at a right-most position (home position) in a movable area of the carriage 817. When printing is not carried out for some time, the carriage 817 moves to this home position, and the nozzles are covered airtightly by the cap 822. The cap 822 is connected to a pump 821 by non-illustrated piping. The pump 821 is operated by driving of the motor 820, so as to suck out thickened ink in the nozzles. The motor 820 is also used as a power source for driving a sheet feed drive shaft 819, on which a drive roller for feeding the cut sheet 816 is attached.

An ink ejection detector 814 is disposed at a left-most position in the movable area of the carriage 817. An ink saucer is set below the ink ejection detector 814 to receive ink ejected when the nozzles are subjected to blind ejection (for refreshing). As described later, ejection check of ink droplets is carried out at this position. The position for checking the ink ejection may be on the right side of the movable area of the carriage 817. In the latter case, the cap 822 may be used as the ink saucer for blind ejection. If the cap 822 acts as the ink saucer, both types of discharged ink discharged by the blind ejection and by the sucking of the nozzles are treated by a single unit including the cap 822 and a discharged ink absorber (not shown). This arrangement will simplify the structure of the printer.

Figure 30:
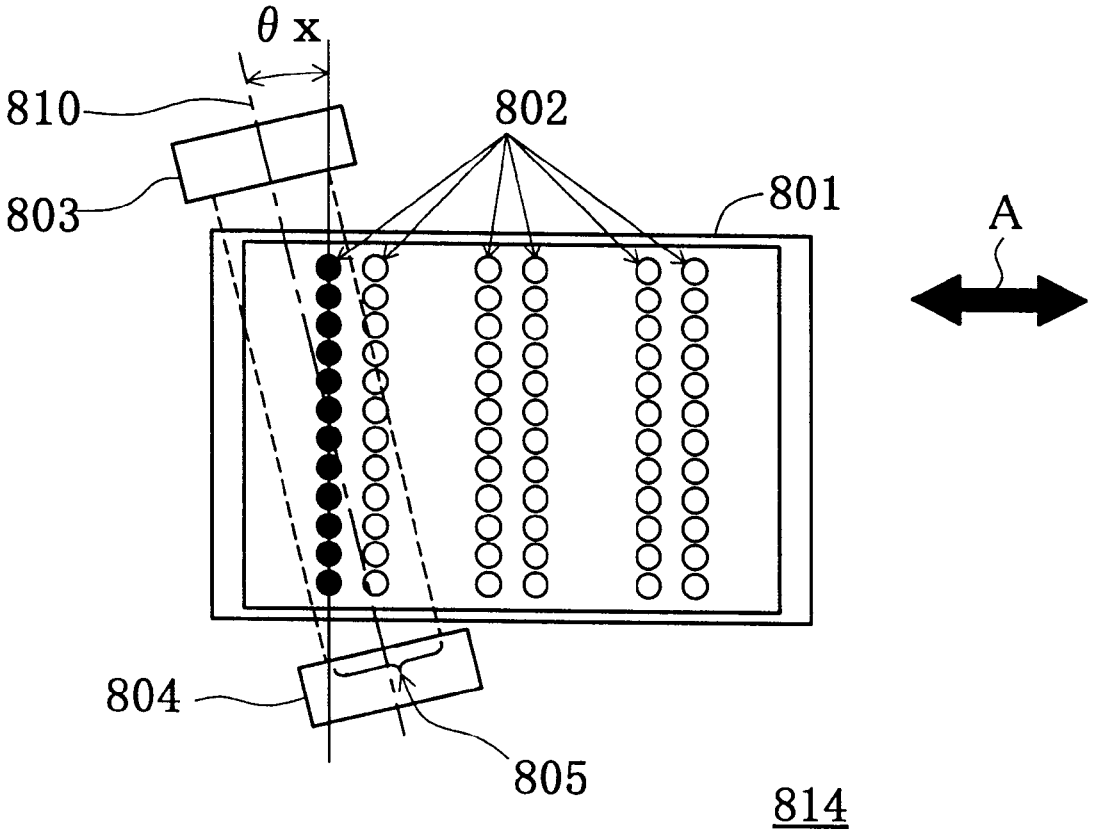
FIG. 30 shows a positional relationship between an ink ejection detector and a head, seen from the top of the head, in the ink jet printer of the present invention.
Figure 31:
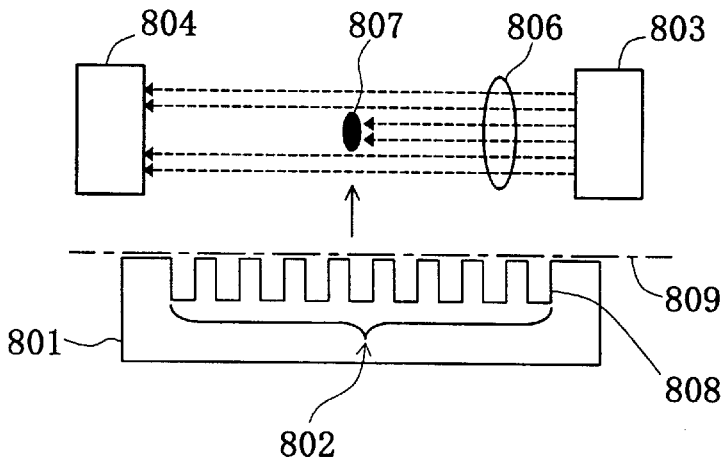
FIG. 31 shows the positional relationship between the ink ejection detector and the head, seen from the cross section of the head, in the ink jet printer of the present invention.
Figure 32:
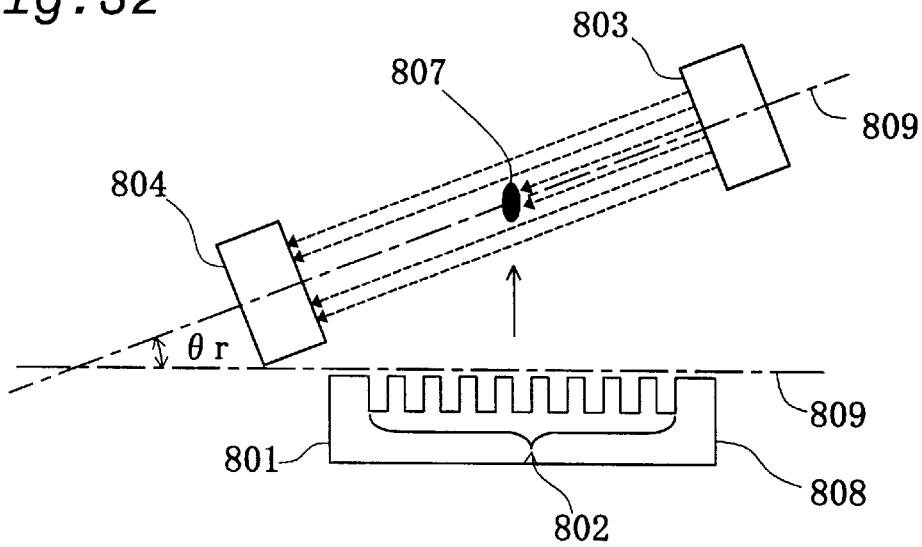
FIG. 32 shows an application of the ink ejection detector in the ink jet printer of the present invention.
Figure 33:
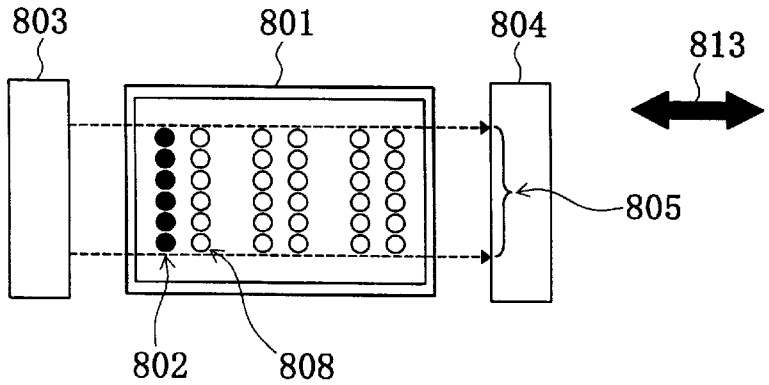
FIG. 33 shows a positional relationship between an ink ejection detector and a head in a prior art ink jet printer.

FIG. 30 schematically illustrates a positional relationship between the ink ejection detector and the head, seen from the top of the head nozzle surface, in the ink jet printer of the present invention. FIG. 31 schematically illustrates the positional relationship, seen from the cross section of the head nozzle surface. FIG. 32 shows an ink ejection detector in an ink jet printer as one application of the present invention.

Referring to FIG. 30, a light detection unit 814 has a light-emitter 803 and a light-receiver 804 that scan at a predetermined angle, which is attained by a clockwise or counterclockwise rotation about the center of the nozzle array, relative to the head 801 with a plurality of nozzle arrays 802 and the columnar direction of the nozzles arrays 802. The light detection unit is disposed at a position where light is scattered by ink droplets ejected by the nozzle array on the head. In this embodiment, the light detector unit is located at a specific position which is one end of the moving path of the print head along an arrow A and is opposite to the home position. The light detector unit may, however, be disposed at the home position or in the middle of the moving path of the print head. The light detector unit may be attached to the print head. This arrangement enables a check for ejection of ink droplets all the time including the time of blind ejection and the time of printing.

An angle θx of an optical axis 810 of the light detector unit relative to the columnar direction of the nozzle arrays 802 is preset to enable a light sensor sensitive area 805 of the light detector unit to be fully utilized. Namely the angle θx is set to maximize a light-shielding area of ink droplets in the light sensor sensitive area 805.

When the nozzle array has a greater number of nozzles, some nozzles may be out of the sensor sensitive area 805, especially nozzles on both ends of the nozzle array. In order to solve this problem, the angle θx of the optical axis 810 is adjusted so that the target nozzles for the detection are fully included in the sensor sensitive area 805.

When the nozzle array has a less number of nozzles, on the contrary, there is a margin in the sensor sensitive area 805 relative to the nozzle arrays. The angle θx of the optical axis 810 is adjusted so that the nozzles on both ends of the nozzle array are fully included in the sensor sensitive area 805.

The above arrangement adjusts the angle θx of the optical axis 810 of the light detector unit relative to the columnar direction of the nozzle arrays 802 according to the number of nozzles included in the nozzle arrays, so as to enable the light sensor sensitive area 805 to be fully utilized. Alternatively, an angle θy of the optical axis 810 of the light detector unit relative to a nozzle surface 809 as shown in FIG. 32 may be adjusted to enable the light sensor sensitive area 805 to be fully utilized.

The fully utilization of the light sensor sensitive area 805 may be effected by adjusting both the angle θx of the optical axis 810 of the light detector unit relative to the nozzle arrays and the angle θy of the optical axis 810 of the light detector unit relative to the head nozzle surface.

The following describes a technique of detecting ink ejection and canceling the clogging of nozzles in the embodiment of the present invention. The state of the nozzles is detected at a position apart from the printing medium, prior to spraying a jet of ink droplets against the printing medium for printing.

In the light detector unit 814, a ray of detection light 806 is emitted from the light-emitting light sensor unit 803 towards the light-receiving light sensor unit 804. Prior to detection of ink droplets, the technique checks whether the detection light 806 emitted from the light-emitting light sensor unit 803 is received by the light-receiving light sensor unit 804 under the condition of no ejection of ink droplets from the nozzle array 802. An ink droplet 807 is then ejected from a nozzle 808 disposed on the nozzle surface or on the edge of the head 801 and flies across the detection light 806 emitted from the light-emitting light sensor unit 803. The ink droplet 807 scatters the detection light 806 and varies the quantity of light reaching the light-receiving light sensor unit 804. The technique detects the variation in the form of an electric signal, so as to determine whether an ink droplet is ejected from the nozzle 808.

In a similar manner, the head 801 is minutely moved in the direction of the arrow A relative to another nozzle array when required, and the above procedure is repeated to determine whether any of the nozzles in the nozzle array 802 is clogged up.

Even if the clogging of one nozzle is detected, the technique does not immediately carry out an operation for freeing the clogging, but continues detection of ink ejection to the last nozzle in the nozzle array 802. After completion of the detection of ink ejection with regard to all the nozzles in the nozzle array 802, the process carries out the ejecting action several times for the clogged nozzles, while checking whether ink droplets are actually ejected from these nozzles, so as to free the clogged nozzles. When the clogging is not settled even after the ejecting action is carried out several times, an operation for freeing the clogging, is automatically performed with the cap 822 and the pump 821.

After setting the clogging, the technique carries out the above process to determine whether any of the nozzles is clogged with regard to a next (or adjoining) nozzle array and perform the operation for freeing the clogged nozzles. The present invention carries out the procedure of detecting ink ejection and freeing the clogged nozzles array by array. In the case where the head has a small number of nozzles, however, the operation for freeing the clogged nozzles may be performed after completion of the detection of ink ejection with regard to all the nozzles.

As described above, the arrangement of the present invention disposes the ink ejection detector at a predetermined angle relative to the head nozzle arrays, so as to maximize the light-shielding area of the sensor. This improves the sensitivity of the sensor and enables clogged nozzles to be detected effectively not with an expensive, highly sensitive ink ejection detector but with an inexpensive ink ejection detector, even if the number of nozzles or the nozzle density is increased. The present invention carries out detection of ink ejection on an array-by-array bases in the ink jet printer. Even if there are a plurality of nozzles that do not eject ink in one nozzle array, the present invention does not recover the ink ejection nozzle by nozzle but carries out the recovery of ink ejection array by array, thereby shortening the time required for recovery of ink ejection. This is especially effective when the head has a high nozzle density.

What is claimed is:

1. An ink jet printer having a carriage and a print head, said carriage being configured to be able to reciprocate relative to a printing medium, said print head being mounted on said carriage and having a plurality of nozzle arrays for ejecting ink droplets, said ink jet printer further comprising:

a light detection unit that scans the plurality of nozzle arrays at a predetermined angle relative to a columnar direction of the nozzle arrays, said angle being attained by a clockwise or a counterclockwise rotation about a center of each nozzle array.

2. An ink jet printer in accordance with claim 1, wherein said light detection unit includes a light sensor that is disposed at a specific position so that light is scattered by ink droplets ejected from each nozzle array.

3. An ink jet printer in accordance with claim 2, wherein said light detection unit is disposed at the predetermined angle, so that a sensitive area of said light sensor is fully utilized with regard to each nozzle array.

4. An ink jet printer in accordance with claim 1, wherein said light detection unit has an optical axis arranged at a preset angle relative to a head nozzle surface.

5. An ink jet printer comprising:

a print head, a carriage and an ejection detector, said print head having a plurality of nozzles in arrays, for ejecting ink droplets, said carriage reciprocating said print head relative to a printing medium, said light detection unit detecting an ejection state of each nozzle, wherein said light detection unit includes a light-emitting element and a light-receiving element, an optical axis connecting said light-emitting element with said light-receiving element being arranged at a predetermined angle relative to a columnar direction of the nozzles, wherein said light detection unit carries out inspection for ejection of ink droplets with regard to at least part of the plurality of nozzles while said print head is moving relative to said light detection unit at a fixed speed.

6. An ink jet printer in accordance with claim 5, wherein said light detection unit has a sensitive area within a predetermined distance from the optical axis, in which ink droplets are detected, said light detection unit being arranged at the predetermined angle relative to the columnar direction of the nozzles in order to cause nozzles on both ends of each nozzle array among the plurality of nozzles, to be within the sensitive area.

7. An ink jet printer in accordance with claim 5, wherein said light detection unit is arranged at a home position of said print head.

8. An ink jet printer in accordance with claim 7, wherein the home position is a position of blind ejection for recovery of the nozzles.

9. An ink jet printer in accordance with claim 5, wherein said light detection unit is disposed on either one of said print head and said carriage with said print head mounted thereon.

10. An ink jet printer in accordance with claim 5, wherein the plurality of nozzles constitute at least one nozzle array having a fixed nozzle pitch in a predetermined alignment direction, said light emitting element emits a light beam that advances in a specific direction having an angle θ relative to the predetermined alignment direction (where θ is greater than θ and less than 180 degrees), and said print head ejects ink droplets towards the light beam while said print head is moving relative to said light detection unit at the fixed speed.

11. An ink jet printer in accordance with claim 10, wherein said print head causes all nozzles included in one specific nozzle array to successively eject ink droplets during a time interval from a time when the light beam intersects with an ink droplet ejected from a nozzle at one end of the specific nozzle array till a time when the light beam intersects with an ink droplet ejected from a nozzle at the other end of the specific nozzle array, and the ink jet printer satisfies:

$$\sin\theta \geqq La/D,\ CRVIF \leqq La/\cos\theta$$

where D denotes the nozzle pitch in the predetermined alignment direction, La denotes a width of the light beam emitted from said light emitting element, CRV denotes a moving speed of said print head relative to said light detection unit, and F denotes a frequency of ejection of ink droplets.

12. An ink jet printer in accordance with claim 10, wherein said print head causes all nozzles included in one specific nozzle array to successively eject ink droplets during a time interval from a time when the light beam intersects with an ink droplet ejected from a nozzle at one end of the specific nozzle array till a time when the light beam intersects with an ink droplet ejected from a nozzle at the other end of the specific nozzle array, and the ink jet printer satisfies:

$$\sin\theta > La/D,\ CRV/F \leqq La/\cos\theta$$

where D denotes the nozzle pitch in the predetermined alignment direction, La denotes a width of the light beam emitted from said light emitting element, CRV denotes a moving speed of said print head relative to said light detection unit, and F denotes a frequency of ejection of ink droplets.

13. An ink jet printer in accordance with claim 10, wherein the plurality of nozzles constitutes in a plurality of nozzle arrays, and the ink jet printer satisfies:

$$\tan\theta \leqq LD/(D\times(N-1))$$

where LD denotes an interval between adjoining nozzle arrays and N denotes a number of nozzles included in each nozzle array.

14. An ink jet printer in accordance with claim 10, wherein the plurality of nozzles constitutes in a plurality of nozzle arrays, and the ink jet printer satisfies:

$$\tan\theta < LD/(D\times(N-1))$$

where LD denotes an interval between adjoining nozzle arrays and N denotes a number of nozzles included in each nozzle array.

15. An ink jet printer in accordance with claim 10, wherein the plurality of nozzles are classified into a plurality of inspection groups, and one inspection group is selected, as an object to be inspected, among the plurality of inspection groups so that the selected inspection group is inspected during one pass of movement of said print head relative to said light detection unit in a predetermined direction.

16. An ink jet printer in accordance with claim 15, wherein nozzles included in one identical inspection group are selected so that ink droplets ejected from two or more nozzles do not simultaneously intercept the light beam emitted from said light emitting element.

17. An ink jet printer in accordance with claim 16, wherein the plurality of nozzles constitutes in a plurality of nozzle arrays, and each of the plurality of inspection groups includes nozzles that are periodically selected at a ratio of one every n nozzles (where n is an integer of at least 2) out of at least one nozzle array among the plurality of nozzle arrays.

18. An ink jet printer in accordance with claim 17, wherein each of the plurality of inspection groups includes nozzles that are selected from nozzle arrays, which are periodically selected at a ratio of one every m nozzle arrays (where m is an integer of at least 2) among the plurality of nozzle arrays.

19. An ink jet printer in accordance with claim 16, wherein different priorities corresponding to a sequence of execution of the inspection are allocated to the plurality of inspection groups, and the inspection group having a higher priority includes a greater number of nozzles.

20. An ink jet printer in accordance with claim 5, wherein said print head is driven by said carriage to move bi-directionally in a main scanning direction, a movable range of said print head in the main scanning direction includes a printing area, in which said print head causes the plurality of nozzles to eject ink droplets so as to implement printing on said printing medium, and an adjustment area, in which the inspection of the plurality of nozzles for ejection of ink droplets and a flushing operation of the plurality of nozzles are carried out, and said light detection unit carries out the inspection for ejection in the adjustment area, prior to the flushing operation, at a time point when said print head reaches the adjustment area after execution of the printing in the printing area and before said print head returns from the adjustment area to the printing area.

21. An ink jet printer in accordance with claim 5, wherein the plurality of nozzles are classified into a plurality of inspection groups, said print head is driven by said carriage to move bi-directionally in a main scanning direction, a movable range of said print head in the main scanning direction includes a printing area, in which said print head causes the plurality of nozzles to eject ink droplets so as to implement printing on said printing medium, and an adjustment area, in which the inspection of the plurality of nozzles for ejection of ink droplets and a flushing operation of the plurality of nozzles are carried out, and said light detection unit carries out the inspection of one of the inspection groups for ejection in the adjustment area respectively in a forward pass and a backward pass of said print head, at a time point when said print head reaches the adjustment area after execution of the printing in the printing area and before said print head returns from the adjustment area to the printing area.

22. An ink jet printer in accordance with claim 21, wherein the printing is not carried out in the printing area in a selected one of the forward pass and the backward pass of said print head, said carriage feeds said print head at a higher speed in the pass on which the printing is not executed, than in the other pass, and a feeding speed of said print head is lowered to a specific level suitable for the inspection prior to the inspection, when the inspection for ejection is carried out in the pass on which said print head is fed at the higher speed.

23. A method of detecting an inactive nozzle in an ink jet printer, which comprises a carriage that is configured to reciprocate relative to a printing medium, and a print head that is mounted on said carriage and has a plurality of nozzle arrays for ejecting ink droplets, said method comprising the step of:

scanning the plurality of nozzle arrays at a predetermined angle relative to a columnar direction of the nozzle arrays, wherein said angle is attained by a clockwise or a counterclockwise rotation about a center of each nozzle array.

24. A method in accordance with claim 10, further comprising the step of:

emitting the light beam to a specific position that the light is scattered by ink droplets ejected from each nozzle array.

25. A method in accordance with claim 24, further comprising the step of:

emitting the light beam at the predetermined angle, so that a sensitive area of a light sensor detecting an ejection state of each nozzle by the light beam is fully utilized with regard to each nozzle array.

26. A method in accordance with claim 10, said method further comprising the step of:

emitting the light beam so that an optical axis of the light beam has a preset angle relative to a head nozzle surface.

27. A method of detecting an inactive nozzle in an ink jet printer, which comprises a print head that has a plurality of nozzles in arrays for ejecting ink droplets, a carriage that reciprocates said print head relative to a printing medium, and a light detection unit that includes a light-emitting element and a light-receiving element and detects an ejection state of each nozzle, said method comprising the steps of:

emitting a light beam so that an optical axis of the light beam connecting said light-emitting element with said light-receiving element has a predetermined angle relative to a columnar direction of the nozzles, and inspecting for ejection of ink droplets at least part of the plurality of nozzles while said print head is moving relative to said light detection unit.

28. A method in accordance with claim 27, wherein the light beam has a sensitive area within a predetermined distance from the optical axis, in which ink droplets are detected, said method further comprising the step of:

emitting the light beam at the predetermined angle relative to the columnar direction of the nozzles in order to cause nozzles on both ends of each nozzle array among the plurality of nozzles, to be within the sensitive area.

29. A method in accordance with claim 27, said method further comprising the step of:

detecting an ejected ink droplet at a home position of said print head.

30. A method in accordance with claim 27, said method further comprising the step of:

carrying out a blind ejection for recovery of the nozzles at the home position.

31. A method in accordance with claim 14, wherein the movement of said print head relative to said light detection unit is performed at a fixed speed.

32. A method in accordance with claim 31, wherein the plurality of nozzles constitute at least one nozzle array having a fixed nozzle pitch in a predetermined alignment direction, said method comprising the steps of:

(a) emitting a light beam that advances in a specific direction having an angle θ relative to the predetermined alignment direction (where θ is greater than 0 and less than 180 degrees), and (b) ejecting ink droplets towards the light beam while said print head is moving relative to said light detection unit at the fixed speed.

33. A method in accordance with claim 32, said method further comprising the step of:

(c) classifying the plurality of nozzles into a plurality of inspection groups, wherein said step (b) comprises the step of:

selecting one inspection group, as an object to be inspected, among the plurality of inspection groups so that the selected inspection group is inspected during one pass of movement of said print head relative to said light detection unit in a predetermined direction.

34. A method in accordance with claim 33, wherein said step (c) comprises the step of:

classifying the plurality of nozzles so that ink droplets ejected from two or more -nozzles included in an identical inspection group do not simultaneously intercept the light beam emitted from said light emitting element.

35. A method in accordance with claim 34, wherein the plurality of nozzles constitutes in a plurality of nozzle arrays, and said step (c) further comprises the step of:

classifying the plurality of nozzles, in order to make each of the plurality of inspection groups include nozzles that are periodically selected at a ratio of one every n nozzles (where n is an integer of at least 2) out of at least one nozzle array among the plurality of nozzle arrays.

36. A method in accordance with claim 35, wherein said step (c) further comprises the step of:

selecting nozzles included in each of the plurality of inspection groups from nozzle arrays, which are periodically selected at a ratio of one every m nozzle arrays (where m is an integer of at least 2) among the plurality of nozzle arrays.

37. A method in accordance with claim 34, wherein said step (c) further comprises the step of:

allocating different priorities corresponding to a sequence of execution of the inspection to the plurality of inspection groups, and classifying the plurality of nozzles so that the inspection group having a higher priority includes a greater number of nozzles.

38. A method in accordance with claim 27, wherein said print head is driven by said carriage to move bi-directionally in a main scanning direction, a movable range of said print head in the main scanning direction includes a printing area, in which said print head causes the plurality of nozzles to eject ink droplets so as to implement printing on said printing medium, and an adjustment area, in which the inspection of the plurality of nozzles for ejection of ink droplets and a flushing operation of the plurality of nozzles are carried out, and said inspecting step comprises the step of:

carrying out the inspection for ejection in the adjustment area, prior to the flushing operation, at a time point when said print head reaches the adjustment area after execution of the printing in the printing area and before said print head returns from the adjustment area to the printing area.

39. A method in accordance with claim 37 wherein the plurality of nozzles are classified into a plurality of inspection groups, said print head is driven by said carriage to move bi-directionally in a main scanning direction, a movable range of said print head in the main scanning direction includes a printing area, in which said print head causes the plurality of nozzles to eject ink droplets so as to implement printing on said printing medium, and an adjustment area, in which the inspection of the plurality of nozzles for ejection of ink droplets and a flushing operation of the plurality of nozzles are carried out, and said inspecting step comprises the step of:

carrying out the inspection of one of the inspection groups for ejection in the adjustment area respectively in a forward pass and a backward pass of said print head, at a time point when said print head reaches the adjustment area after execution of the printing in the printing area and before said print head returns from the adjustment area to the printing area.

40. A method in accordance with claim 39, wherein the printing is not carried out in the printing area in a selected one of the forward pass and the backward pass of said print head, said print head is fed at a higher speed in the pass on which the printing is not executed, than in the other pass, and said inspecting step comprises the step of:

lowering a feeding speed of said print head to a specific level suitable for the inspection prior to the inspection, when the inspection for ejection is carried out in the pass on which said print head is fed at the higher speed.

41. A computer readable recording medium, in which a specific computer program is recorded, said specific computer program causing a computer comprising an ink jet printer to detect an inactive nozzle, said ink jet printer comprising a print head having a plurality of nozzles, from which ink droplets are ejected, a light detection unit having a light emitting element that emits a light beam and a light receiving element that receives the light beam emitted from said light emitting element, and a carriage that moves at least one of said print head and said light detection unit, so as to shift said print head relative to said light detection unit, said ink jet printer ejecting ink droplets to implement printing, said specific computer program causing the computer to carry out inspection with regard to at least part of the plurality of nozzles while said print head shifts relative to said light detection unit.

* * * * *